US008396410B2

(12) United States Patent
Yokoya et al.

(10) Patent No.: US 8,396,410 B2
(45) Date of Patent: Mar. 12, 2013

(54) BOOKBINDING SYSTEM AND BOOKBINDING APPARATUS

(75) Inventors: Takashi Yokoya, Kashiwa (JP); Naoto Watanabe, Abiko (JP); Mitsuhiko Sato, Kashiwa (JP); Hidenori Sunada, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/313,935

(22) Filed: Dec. 7, 2011

(65) Prior Publication Data

US 2012/0076617 A1 Mar. 29, 2012

Related U.S. Application Data

(63) Continuation of application No. 12/046,357, filed on Mar. 11, 2008, now Pat. No. 8,086,165.

(30) Foreign Application Priority Data

Mar. 28, 2007 (JP) ..... 2007-084689

(51) Int. Cl.
*G03G 15/00* (2006.01)

(52) U.S. Cl. ..... 399/408; 399/407

(58) Field of Classification Search ..... 399/408, 399/407

See application file for complete search history.

(56) References Cited

U.S. PATENT DOCUMENTS

| | | | | |
|---|---|---|---|---|
| 7,263,328 | B2 * | 8/2007 | Asai et al. | 399/408 |
| 7,584,949 | B2 * | 9/2009 | Kaneko et al. | 270/58.12 |
| 7,658,584 | B2 * | 2/2010 | Yoshie et al. | 412/11 |
| 7,722,306 | B2 * | 5/2010 | Yokobori et al. | 412/11 |
| 7,877,056 | B2 * | 1/2011 | Yokoya et al. | 399/407 |
| 7,949,293 | B2 * | 5/2011 | Osawa | 399/408 |
| 2004/0098665 | A1 * | 5/2004 | Kasahara et al. | 715/500 |
| 2007/0003346 | A1 * | 1/2007 | Higaki et al. | 399/408 |
| 2007/0036637 | A1 * | 2/2007 | Hata et al. | 412/9 |

* cited by examiner

*Primary Examiner* — Anthony Nguyen

(74) *Attorney, Agent, or Firm* — Canon U.S.A., Inc. IP Division

(57) ABSTRACT

A bookbinding system includes an image forming apparatus and a bookbinding apparatus connected to the image forming apparatus. The bookbinding system includes an image forming unit to form an image on a recording sheet; a loading unit to load, as a bookblock stack, plural recording sheets on which images are formed; a bonding unit to form a booklet by bonding a cover with the bookblock stack; a setting unit to set a bookblock size, a cover size, and a finishing size; a cutting unit to cut the booklet bonded together with the cover into the finishing size; a stack thickness detection unit to detect a thickness of the bookblock stack; and a bookbinding permission/inhibition determination unit to determine permission/inhibition of a bookbinding operation based on a stack thickness detection result as well as the bookblock size, the cover size, and the finishing size set by the setting unit.

10 Claims, 50 Drawing Sheets

BOOKBINDING SYSTEM AND BOOKBINDING APPARATUS

CROSS-REFERENCE TO RELATED APPLICATIONS

This application claims the benefit of U.S. application Ser. No. 12/046,357, filed Mar. 11, 2008, and Japanese Patent Application No. 2007-084689 filed Mar. 28, 2007, which are hereby incorporated by reference herein in their entireties.

BACKGROUND OF THE INVENTION

1. Field of the Invention

The present invention relates to a bookbinding system and a bookbinding apparatus that loads, as bookblock stack (i.e., an inner book part), a plurality of recording sheets discharged from an image forming apparatus, bonds a cover with the bookblock stack, and cuts the bookblock stack bonded together with the cover into a designated size.

2. Description of the Related Art

A conventional bookbinding apparatus performs gluing processing for applying glue to a stack of recording sheets (hereinafter, referred to as "bookblock stack") discharged from an image forming apparatus, bonding processing for bonding a cover with the bookblock stack, and cutting processing for cutting the bookblock stack together with the bonded cover.

As discussed in Japanese Patent Application Laid-Open No. 2005-104063 and Japanese Patent Application Laid-Open No. 2004-209870, a bookbinding system includes an image forming apparatus connected to the bookbinding apparatus.

However, as illustrated in FIG. 48, in a state where a cover is bonded around a bookblock stack, the cover length in a front edge direction varies according to a stack thickness of the bookblock stack. The above-described conventional bookbinding system does not take this variation into consideration.

For example, if a bookblock has a small stack thickness (e.g., if the number of sheets is small), a cutting amount of a cover is large. As illustrated in FIG. 49, if a cut waste 1000 is excessively long, the cut waste 1000 interferes with a waste receiver unit 533. Thus, the waste processing is infeasible.

Furthermore, if the cover length in the front edge direction is long, a bookbinding product (which is not subjected to cutting processing) interferes with a ceiling member 1001 and cannot be discharged as illustrated in FIG. 50.

SUMMARY OF THE INVENTION

Exemplary embodiments of the present invention are directed to a bookbinding system that can prevent a bookbinding apparatus from malfunctioning and can secure a satisfactory quality level of a bookbinding product, thereby improving the usability of the system.

According to an aspect of the present invention, a bookbinding system includes an image forming apparatus and a bookbinding apparatus connected to the image forming apparatus. The bookbinding system includes an image forming unit configured to form an image on a recording sheet; a loading unit configured to load, as a bookblock stack, a plurality of recording sheets on which images are formed by the image forming unit; a bonding unit configured to form a booklet by bonding a cover with the bookblock stack; a setting unit configured to set a bookblock size, a cover size, and a finishing size; a cutting unit configured to cut the booklet bonded together with the cover by the bonding unit into a booklet having the finishing size set by the setting unit; a stack thickness detection unit configured to detect a thickness of the bookblock stack; and a bookbinding permission/inhibition determination unit configured to determine permission/inhibition of a bookbinding operation based on a stack thickness detection result obtained by the stack thickness detection unit as well as the bookblock size, the cover size, and the finishing size set by the setting unit.

According to another aspect of the present invention, a bookbinding system includes an image forming apparatus and a bookbinding apparatus connected to the image forming apparatus. The bookbinding system includes an image forming unit configured to form an image on a recording sheet; a loading unit configured to load, as a bookblock stack, a plurality of recording sheets on which images are formed by the image forming unit; a bonding unit configured to form a booklet by bonding a cover with the bookblock stack; a setting unit configured to set a bookblock size, and a cover size; a stack thickness detection unit configured to detect a thickness of the bookblock stack; and a bookbinding permission/inhibition determination unit configured to determine permission/inhibition of a bookbinding operation based on a stack thickness detection result obtained by the stack thickness detection unit as well as the bookblock size and the cover size set by the setting unit.

According to yet another aspect of the present invention, a bookbinding apparatus is connectable to an image forming apparatus. The bookbinding apparatus includes a loading unit configured to load, as a bookblock stack, a plurality of recording sheets discharged from the image forming apparatus; a bonding unit configured to form a booklet by bonding a cover with the bookblock stack; a reception unit configured to receive a bookblock size, a cover size, and a finishing size from the image forming apparatus; a cutting unit configured to cut the booklet bonded together with the cover by the bonding unit into a booklet having the finishing size set by the setting unit; a stack thickness detection unit configured to detect a thickness of the bookblock stack; and a bookbinding permission/inhibition determination unit configured to determine permission/inhibition of a bookbinding operation based on a stack thickness detection result obtained by the stack thickness detection unit as well as the bookblock size, the cover size, and the finishing size received by the reception unit.

According to yet another aspect of the present invention, a bookbinding apparatus is connectable to an image forming apparatus. The bookbinding apparatus includes a loading unit configured to load, as a bookblock stack, recording sheets discharged from the image forming apparatus; a bonding unit configured to form a booklet by bonding a cover with the bookblock stack; a reception unit configured to receive a bookblock size and a cover size from the image forming apparatus; a stack thickness detection unit configured to detect a thickness of the bookblock stack; and a bookbinding permission/inhibition determination unit configured to determine permission/inhibition of a bookbinding operation based on a stack thickness detection result obtained by the stack thickness detection unit as well as the bookblock size and the cover size received by the reception unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain at least some of the principles of the invention.

DETAILED DESCRIPTION OF THE EMBODIMENTS

Figure 1:
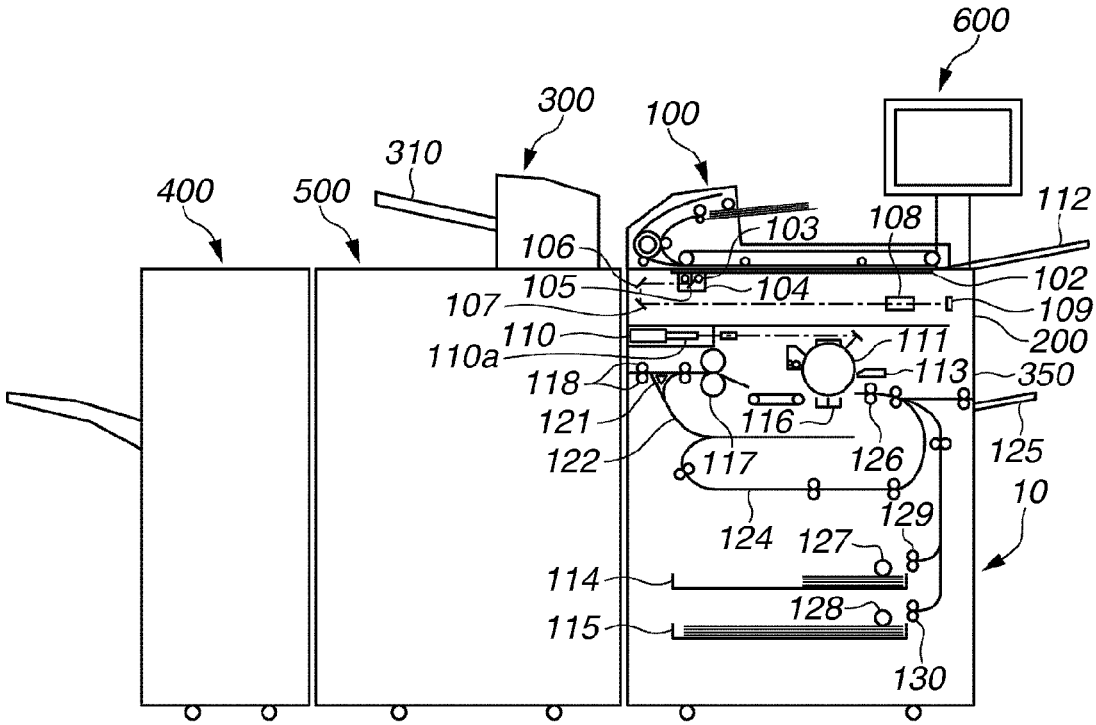
FIG. 1 illustrates a bookbinding system according to an exemplary embodiment of the present invention.

The following description of exemplary embodiments is illustrative in nature and is in no way intended to limit the invention, its application, or uses. It is noted that throughout the specification, similar reference numerals and letters refer to similar items in the following figures, and thus once an item is described in one figure, it may not be discussed for following figures. Exemplary embodiments will be described in detail below with reference to the drawings.

First Exemplary Embodiment

FIG. 1 illustrates a vertical cross-sectional view of essential parts of a bookbinding system according to a first exemplary embodiment of the present invention. The bookbinding system illustrated in FIG. 1 includes an image forming apparatus 10, a case bookbinding apparatus 500, and a finisher 400. The image forming apparatus 10 includes an image reader 200 that reads an image of an original and a printer 350 that forms a read image on a recording sheet.

More specifically, the image reader 200 is associated with a document feeder 100 mounted thereon. The document feeder 100 conveys the original (e.g., document papers or pages) stacked on a document tray with face up one after another from the top thereof to a left side on the drawing surface of FIG. 1. Then, the document feeder 100 guides the conveyed original from left to right along a curved path via a flow-reading position on a platen glass 102. Then, the document feeder 100 discharges the original to an external sheet discharge tray 112. The image reader 200 reads an image of the original when the original passes the flow-reading position on the platen glass 102 from left to right.

The above-described reading method can be referred to as "original flow-reading" method. More specifically, when an original passes a flow-reading position, a lamp 103 of a scanner unit 104 illuminates a surface of the original to be read. The reflection light from the original reaches a lens 108 via mirrors 105, 106, and 107. The light having passed through the lens 108 forms an image on an image forming surface of an image sensor 109.

As described above, when the document feeder 100 conveys the original from left to right to pass the flow-reading position, the scanner unit 104 scans to read the original along a main-scanning direction perpendicular to a conveying direction of the original and a sub-scanning direction corresponding to the conveying direction.

Namely, when the original passes the flow-reading position, the image sensor 109 reads an image of each line of the original in the main-scanning direction. The document feeder 100 also conveys the original in the sub-scanning direction so that the image sensor 109 can read an entire image of the original.

The image sensor 109 converts the optically read image into image data and outputs the image data to an exposure control unit 110 of the printer 350 that inputs the image data as a video signal.

Alternatively, the document feeder 100 can convey and stop the original at a predetermined position on the platen glass 102. In this state, the scanner unit 104 can scan from left to right to read the original. This reading method can be referred to as "original fixed-reading" method.

As a method for reading the original without using the document feeder 100, a user can raise the document feeder 100 upward and place the original on the platen glass 102 and then cause the scanner unit 104 to scan from left to right to read the original. In other words, a user can select the "original fixed-reading" operation when reading the original without using the document feeder 100.

The exposure control unit 110 of the printer 350 modulates a laser beam based on a video signal input from the image reader 200 and outputs the modulated laser beam toward a polygon mirror. The polygon mirror performs scanning to irradiate a photosensitive drum 111 with the modulated laser beam, so that an electrostatic latent image can be formed on the photosensitive drum 111 according to a scanning of the laser beam. A developing unit 113 supplies a developing agent onto the photosensitive drum 111 to visualize the electrostatic latent image (referred to as developed agent image).

The printer 350 includes an upper cassette 114 and a lower cassette 115 from which a recording sheet can be supplied by pickup rollers 127 and 128 and conveyed by feeding rollers 129 and 130 to registration rollers 126. After a front edge of the recording sheet reaches the registration rollers 126, the registration rollers 126 rotate at predetermined timing to convey the recording sheet into a clearance between the photosensitive drum 111 and a transfer unit 116. The transfer unit 116 can transfer the developed agent image formed on the photosensitive drum 111 onto the supplied recording sheet.

A fixing unit 117 receives the recording sheet onto which the developed agent image is transferred. The fixing unit 117 applies heat and pressure on the recording sheet to fix the developed agent image. The recording sheet, having passed through the fixing unit 117, successively passes a diverter 121 and discharge rollers 118 and is discharged from the printer 350 to the case bookbinding apparatus 500.

When a recording sheet is discharged in a face-down state (i.e., a state where an image forming surface faces downward), the diverter 121 performs a switching operation to once guide the recording sheet having passed through the fixing unit 117 to a reversing path 122. Then, if a rear edge of the recording sheet has passed through the diverter 121, the discharge rollers 118 cause the recording sheet to make a switchback motion and discharge the recording sheet out of the printer 350. The above-described discharging operation can be referred to as "inversed discharge" operation. The image forming apparatus 10 can perform the inversed discharge operation to form images, in order from the first page, read by using the document feeder 100 or output from a computer, so that the discharged recording sheets can be arrayed in the correct order.

Furthermore, a manual feeding unit 125 enables a user to supply hard recording sheet(s) such as OHP sheet(s). In this case, after an image is formed on the recording sheet supplied from the manual feeding unit 125, the discharge rollers 118 can discharge the recording sheet in a state where an image forming surface faces upward (i.e., a face-up state) without guiding the recording sheet to the reversing path 122.

Furthermore, if a user sets a two-sided recording mode that can form images on both surfaces of a recording sheet, the diverter 121 performs a switching operation to once guide the recording sheet to the reversing path 122 and then convey the recording sheet to a two-sided conveying path 124. Then, at predetermined timing, the recording sheet is conveyed from the two-sided conveying path 124 into the clearance between the photosensitive drum 111 and the transfer unit 116 again.

Next, various functional units of the bookbinding system including the image forming apparatus 10 and the case bookbinding apparatus 500 are described below with reference to a system block diagram illustrated in FIG. 2.

A central processing unit (CPU) 801 is an electronic integrated circuit that performs fundamental controls for the image forming apparatus 10. The CPU 801 is connected to a read only memory (ROM) 802, a random access memory (RAM) 803, and an input/output port 804 via address and data buses. The ROM 802 stores control program(s). The RAM 803 can function as a work memory for the CPU 801 that executes various processing. The RAM 803 includes a memory area serving as backup RAM that can store data even after an electric power source is turned off. The input/output port 804 is connected to an electric loading apparatus, such as a motor and a clutch, controlled by the image forming apparatus 10 and an input apparatus (e.g., a sensor capable of detecting the position of a recording sheet). The CPU 801 performs successive input/output controls via the input/output port 804 and executes image forming processing according to the control program(s) stored in the ROM 802.

An operation display unit 600 is connected to the CPU 801. The CPU 801 controls display on the operation display unit 600 and a key input operation. The operation display unit 600 is described later in detail with reference to FIG. 30. The CPU 801 is connected to an image processing unit 805 that processes an electric signal converted by the image sensor 109 and an image memory unit 806 that stores a processed image.

A communication interface (IF) 807 is a communication IF via which the CPU 801 can communicate with the case bookbinding apparatus 500. The case bookbinding apparatus 500 includes a communication IF 907 via which a control processing unit (CPU) 901 of the case bookbinding apparatus 500 can communicate with the CPU 801 of the image forming apparatus 10. A bookbinding control unit 810 includes a bookbinding operation interrupting unit 811, a cover size resetting unit 812, and a job cancel control unit 813. The bookbinding control unit 810 comprehensively controls the case bookbinding apparatus 500.

The CPU 901 is an electronic integrated circuit that performs fundamental controls for the case bookbinding apparatus 500. The CPU 901 is connected to a read only memory (ROM) 902 that stores control program(s), and a random access memory (RAM) 903 serving as work memory for the CPU 901 that executes various processing via address and data buses. The RAM 903 includes a memory area serving as backup RAM that can store data even after an electric power source is turned off. The CPU 901 controls a bookblock loading unit A, a gluing unit B, a bonding unit C, a cutting unit D, and a finished book discharge unit E, via an input/output port 911, to cause the case bookbinding apparatus 500 to perform a designated bookbinding operation.

Figure 2:
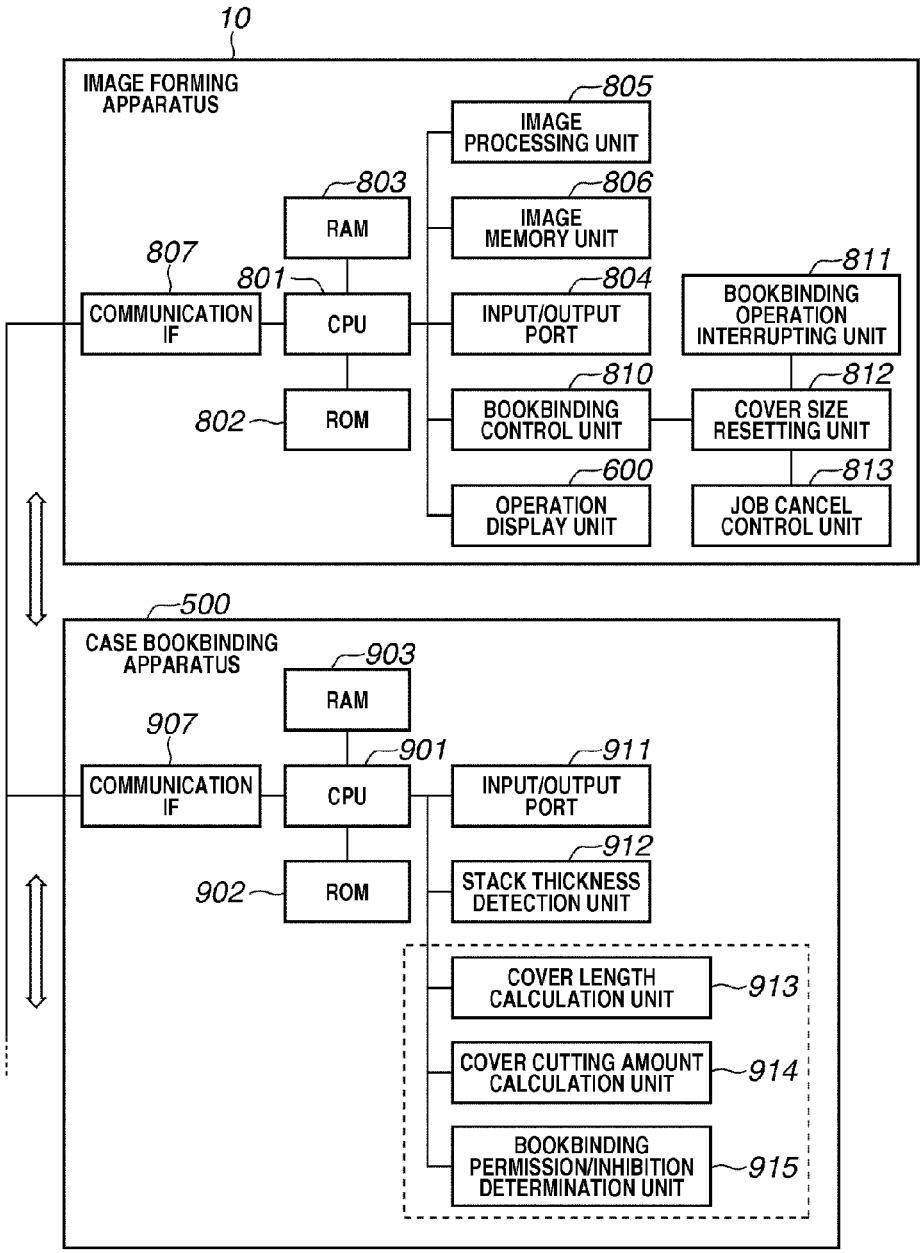
FIG. 2 is a system block diagram illustrating a bookbinding system according to an exemplary embodiment of the present invention.

According to the example illustrated in FIG. 2, the case bookbinding apparatus 500 includes a cover length calculation unit 913, a cover cutting amount calculation unit 914, and a bookbinding permission/inhibition determination unit 915. Alternatively, the image forming apparatus 10 can include the cover length calculation unit 913, the cover cutting amount calculation unit 914, and the bookbinding permission/inhibition determination unit 915.

Figure 3:
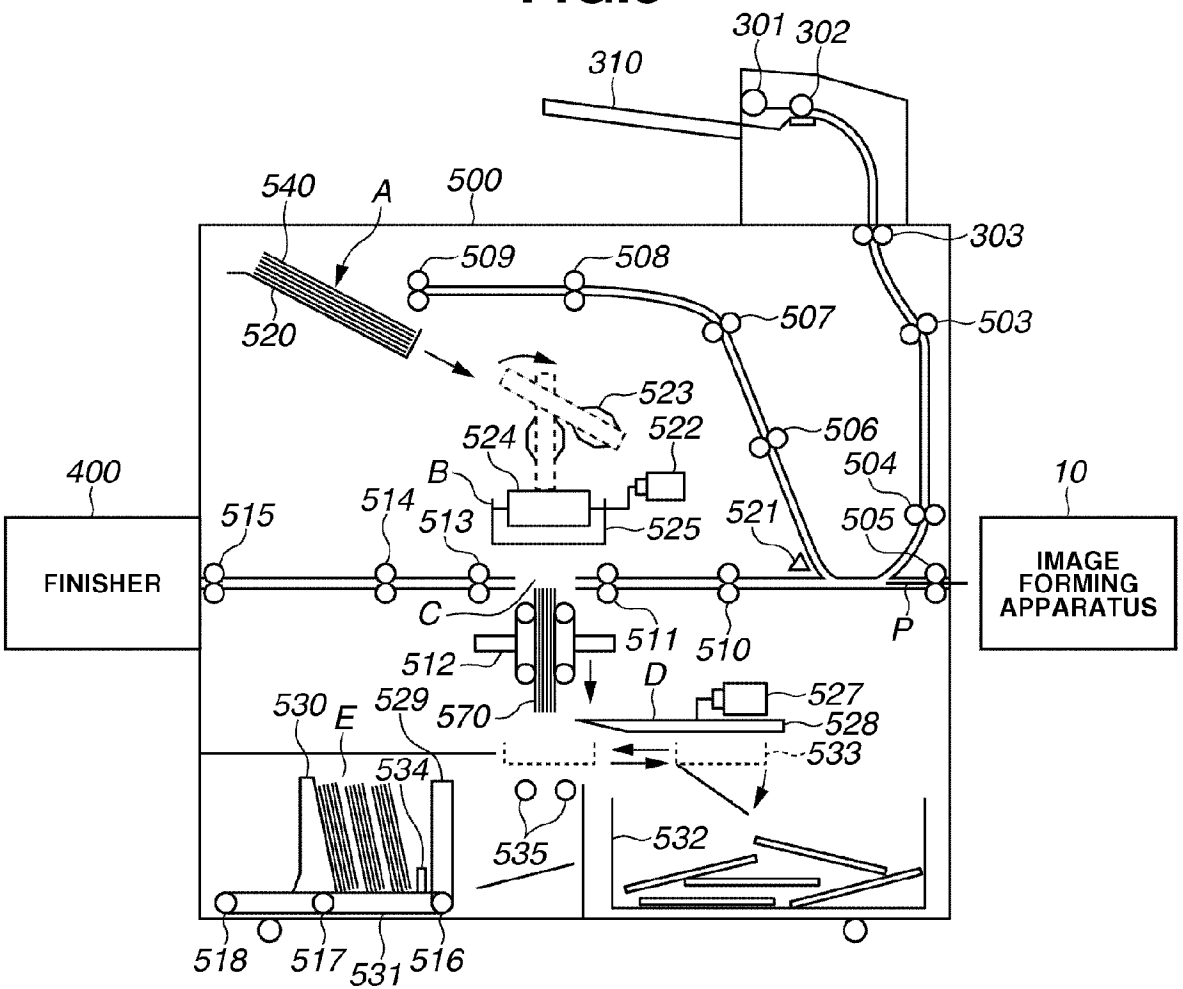
FIG. 3 illustrates a cross-sectional view of a case bookbinding apparatus according to an exemplary embodiment of the present invention.

FIG. 3 illustrates a cross-sectional view of an internal configuration of the case bookbinding apparatus 500. The case bookbinding apparatus 500, connectable to the image forming apparatus 10, includes the bookblock loading unit A, the gluing unit B, the bonding unit C, the cutting unit D, and the finished book discharge unit E. The bookblock loading unit A receives recording sheets discharged from the image forming apparatus 10 operating in a bookbinding mode and forms a bookblock stack. The gluing unit B applies glue to the bookblock stack. The bonding unit C bonds a cover with the glued bookblock stack. The cutting unit D cuts three sides (except for a side to which the glue is applied) of the bookblock stack together with the bonded cover to adjust the size to a finished bookbinding product. The finished book discharge unit E discharges the finished bookbinding product (booklet).

Next, a series of bookbinding operations in the bookbinding mode is described in outline.

The bookblock loading unit A loads recording sheets discharged from the image forming apparatus 10 on a loading tray 520 to form a bookblock stack 540. A gluing gripper 523 holds the bookblock stack 540 loaded by the bookblock loading unit A and sends the bookblock stack 540 to the gluing unit B.

The gluing unit B includes a glue spreading roller 524 that applies glue stored in a glue container 525 to the bookblock stack 540. A glue spreading roller control motor 522 drives the glue spreading roller 524 to apply glue to a lower surface of the bookblock stack 540.

The bonding unit C bonds the glued bookblock stack 540 with a cover discharged from the image forming apparatus 10 and sends a formed booklet 570 to a trim gripper 512. The trim gripper 512 conveys the booklet 570 to the cutting unit D.

The cutting unit D includes a cutter 528 and a cutter control motor 527 that drives the cutter 528. The cutter 528 moves in the horizontal direction to cut the booklet 570 bonded with the cover. The cut waste of the booklet 570 drops into a waste receiver 533. A waste box 532 collects the cut waste from the waste receiver 533 upon completion of the above-described cutting operation. The booklet 570 after cutting operation is conveyed from the cutting unit D to the finished book discharge unit E. The finished book discharge unit E discharges the booklet 570.

In addition to the above-described bookbinding mode for performing a series of bookbinding operations, an ordinary discharge mode is selectable.

A diverter 521, placed on a downstream side of a conveyance roller pair 505, selectively guides a recording sheet conveyed by the conveyance roller pair 505 to the loading tray 520 or to the finisher 400.

In the ordinary discharge mode, a recording sheet P discharged from the image forming apparatus 10 is delivered via conveyance roller pairs 505, 510, 511, 513, 514, and 515 to the finisher 400. The finisher 400 can perform predetermined post-processing, such as stack discharging, stitching, folding, punching, and saddle stitch bookbinding.

Furthermore, in the bookbinding mode, the recording sheet P discharged from the image forming apparatus 10 is delivered via conveyance roller pairs 506, 507, 508, and 509 to the above-described loading tray 520 which forms the bookblock stack 540.

An example paper flow in the case bookbinding apparatus 500 is described below with reference to FIGS. 4 through 7.

Figure 4:
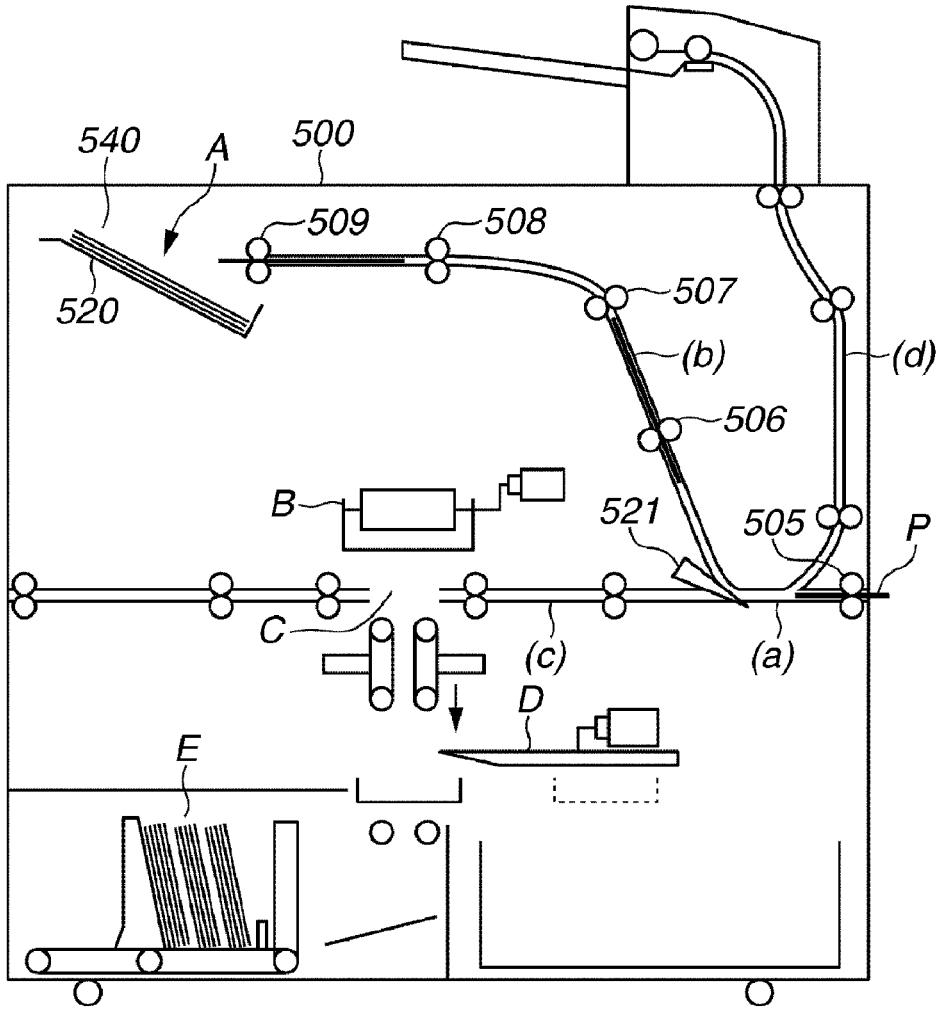
FIG. 4 illustrates an example paper flow in a case bookbinding apparatus.

As illustrated in FIG. 4, the case bookbinding apparatus 500 receives a recording sheet discharged from the image forming apparatus 10 via the conveyance roller pair 505 and guided to a conveying path (a). In the bookbinding mode, the recording sheet P passing through the conveyance roller pair 505 is guided by the diverter 521 to a conveying path (b) and conveyed by conveyance roller pairs 506, 507, 508, and 509.

The recording sheet P is discharged via the conveyance roller pair 509 to the loading tray 520. When all recording sheets forming a bookblock are discharged into the loading tray 520, the sheets are assembled as the bookblock stack 540. Then, the bookblock stack 540 is gripped by the gluing gripper 523 and moved from the bookblock loading unit A to a position above the gluing unit B, as illustrated by a dotted line in FIG. 5.

Figure 6:
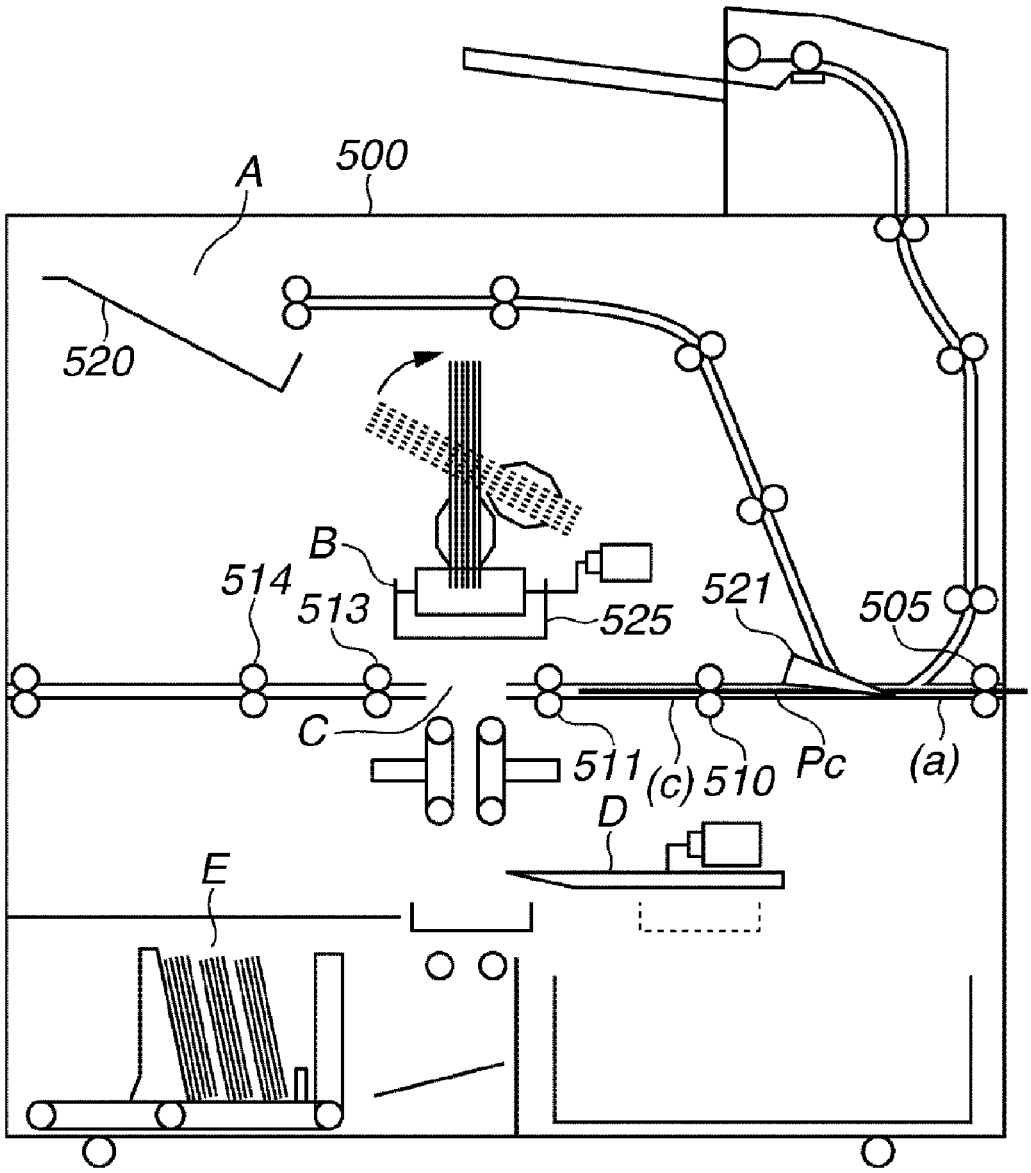
FIG. 6 illustrates an example paper flow in a case bookbinding apparatus.

The bookblock stack 540 gripped by the gluing gripper 523 rotates at the position above the gluing unit B, as illustrated in FIG. 6, so that a spine portion of the bookblock stack 540 faces the gluing unit B. Then, as described later in more detail, the glue container 525 and the glue spreading roller 524 moves together along the bookblock stack 540 to apply glue onto the spine portion of the bookblock stack 540.

Figure 7:
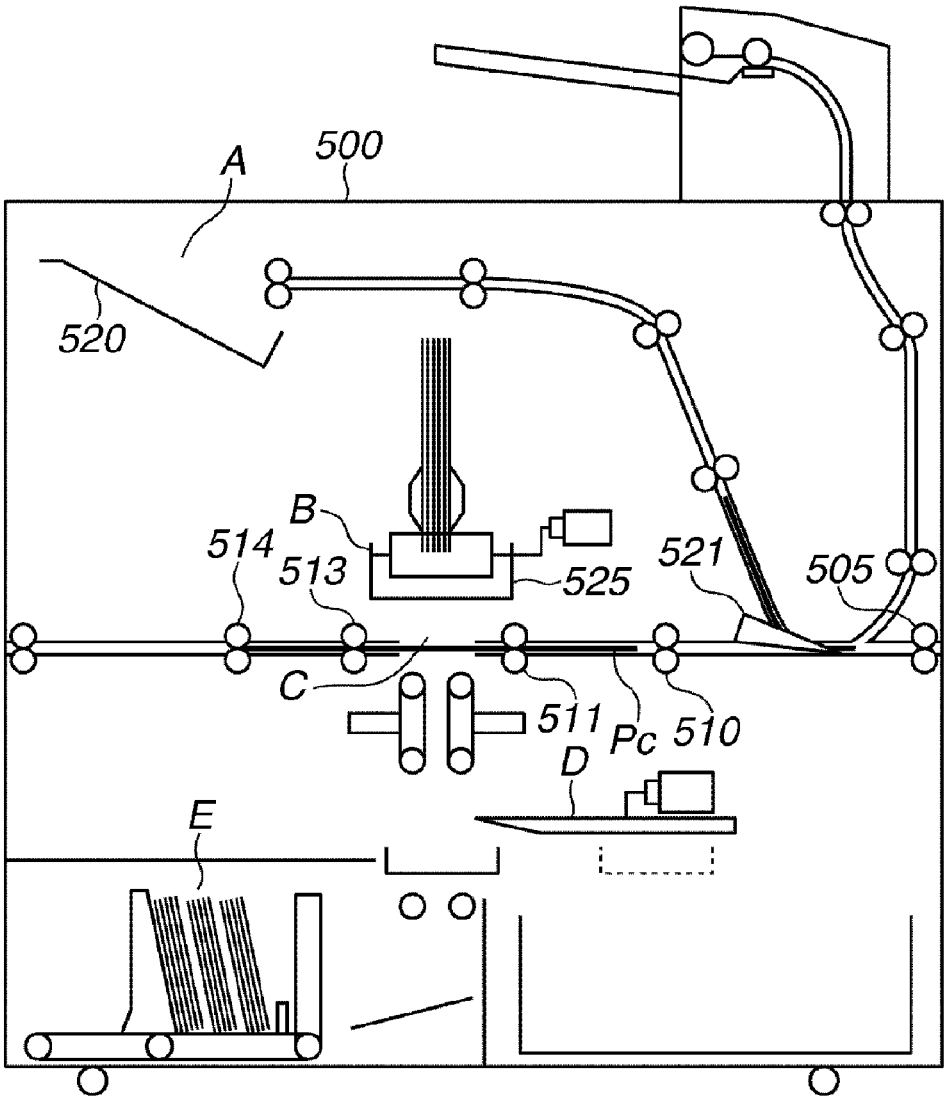
FIG. 7 illustrates an example paper flow in a case bookbinding apparatus.

Meanwhile, a cover Pc delivered from the image forming apparatus 10 is conveyed into the case bookbinding apparatus 500. The cover Pc passing through the conveyance roller pair 505 is guided by the diverter 521 from the conveying path (a) to a conveying path (c) and conveyed by the conveyance roller pairs 510, 511, 513, and 514. On the conveying path (c), a sensor (not illustrated) is provided at a downstream side of the conveyance roller pair 513. If the sensor detects a front edge of the cover Pc, the conveyance roller pair 513 conveys the cover Pc a predetermined distance and stops the cover Pc, as illustrated in FIG. 7.

A rear edge of the cover Pc passes the diverter 521 before the cover Pc stops on the conveying path (c). If the case bookbinding apparatus 500 continuously performs forming of a bookblock stack, the diverter 521 switches its position even when the cover Pc remains on the conveying path (c). Then, the case bookbinding apparatus 500 receives recording sheets from the image forming apparatus 10, and conveys the recording sheets via the conveying path (a) and the conveying path (b) to the loading tray 520 that forms the next bookblock stack. Then, the cover Pc is conveyed to a downstream side to the bookblock stack 540 on which glue is spread. This processing is described later.

Figure 8:
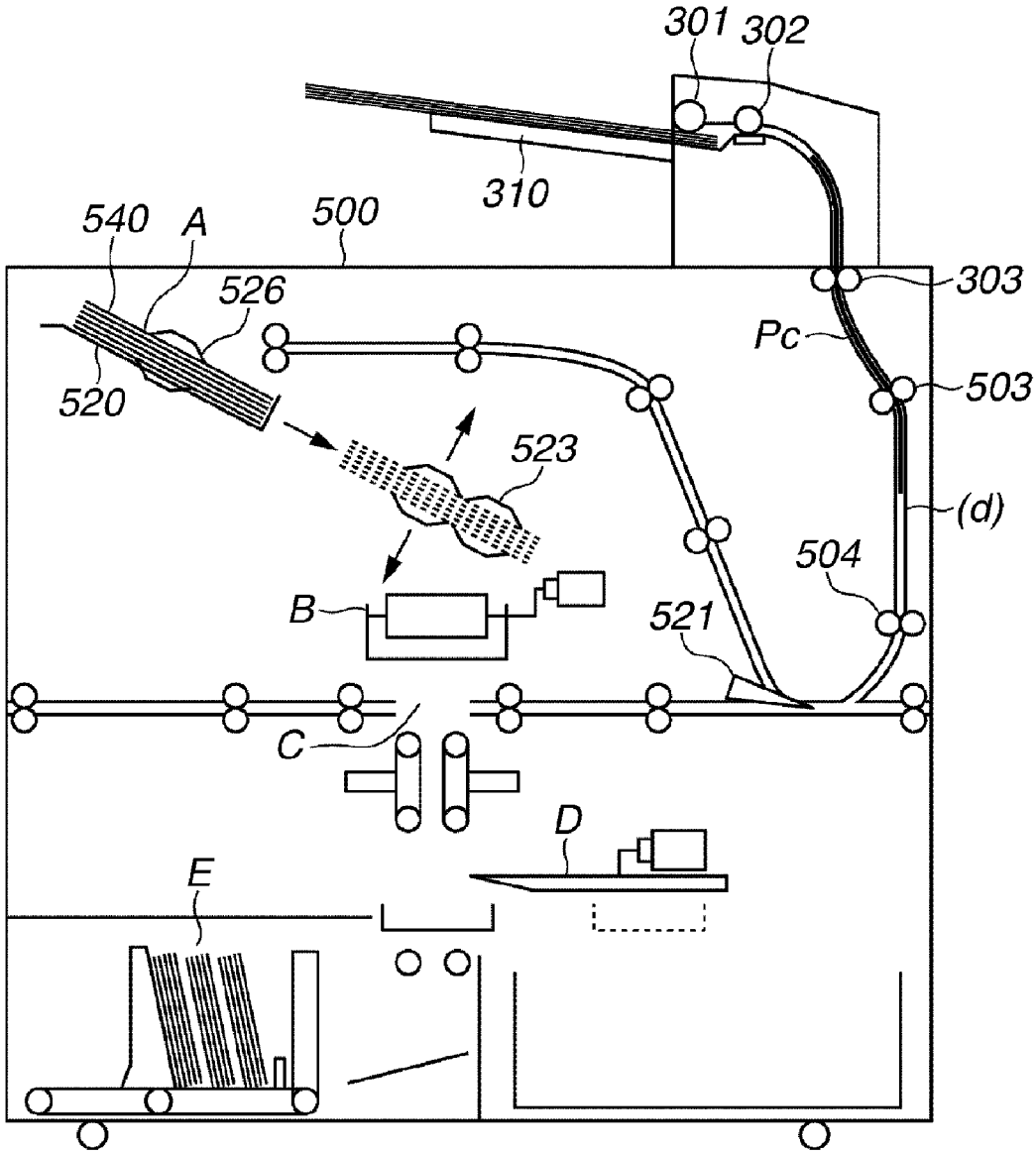
FIG. 8 illustrates an example paper flow in a bookbinding operation using a cover supplied from an inserter.
Figure 9:
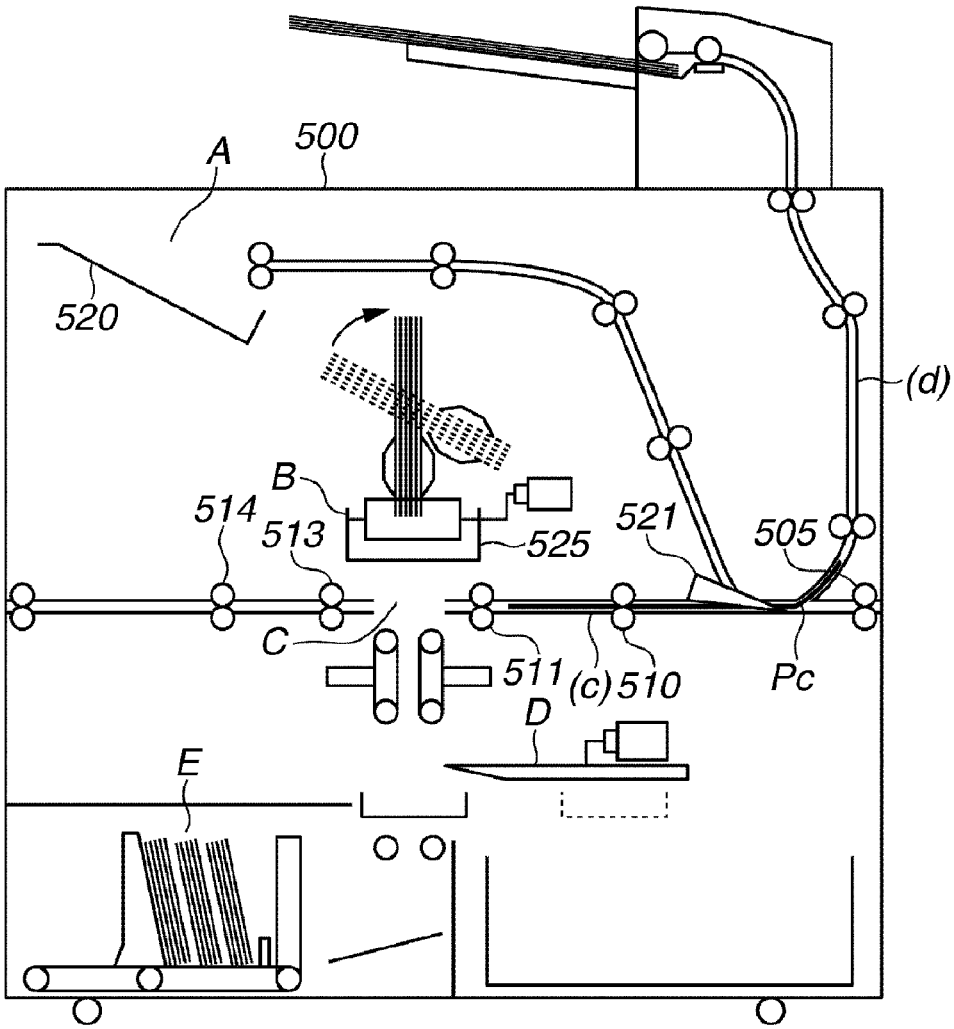
FIG. 9 illustrates an example paper flow in a bookbinding operation using a cover supplied from an inserter.

FIGS. 8 and 9 illustrate an example paper flow in the case bookbinding apparatus 500 which performs a bookbinding operation using a cover supplied from an inserter 300. The inserter 300, provided on an upper part of the case bookbinding apparatus 500, enables a user to supply a cover into the case bookbinding apparatus 500.

Forming the bookblock stack 540 can be realized according to the above-described processing flows illustrated in FIGS. 4 through 7.

When feeding a cover Pc from the inserter 300, a feeding roller 301 picks a topmost sheet (i.e., cover Pc) on a paper feeding tray 310 while the gluing gripper 523 moves the bookblock stack 540 to the gluing unit B as illustrated in FIG. 8. The picked-up cover Pc is conveyed along a conveying path (d) by conveyance roller pairs 303, 503, and 504 and guided by the diverter 521 to the conveying path (c).

Figure 10:
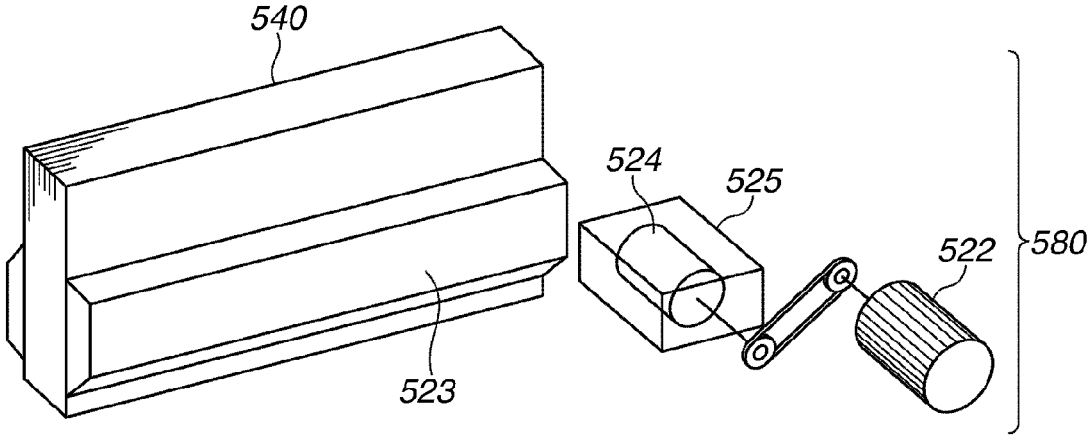
FIG. 10 illustrates an example configuration of a gluing unit.
Figure 11:
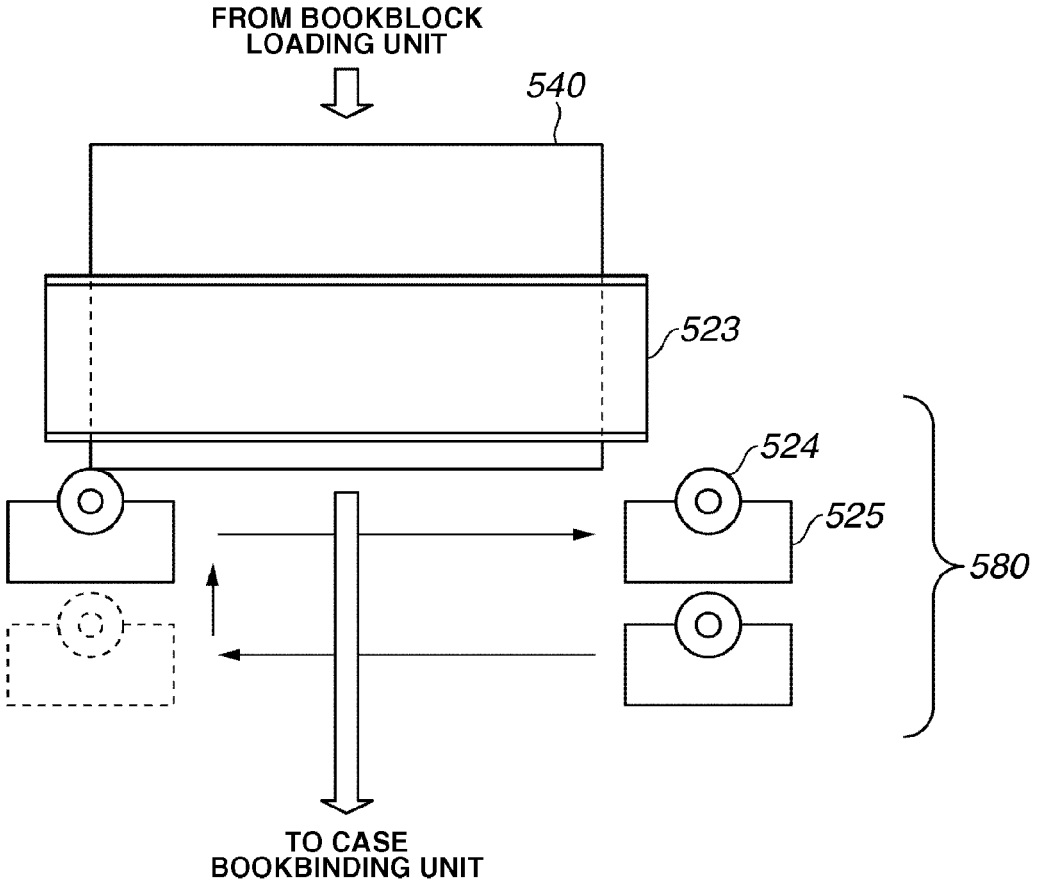
FIG. 11 illustrates an outline of a gluing operation performed by a gluing unit.

FIG. 10 illustrates a detailed configuration of the gluing unit B. FIG. 11 illustrates an outline of a gluing operation performed by the gluing unit. The gluing unit B includes a gluing mechanism 580 in addition to the gluing gripper 523 that grips the bookblock stack 540. The gluing mechanism 580 includes the glue container 525 that stores glue, the glue spreading roller 524 that applies the glue to the bookblock stack 540, and the glue spreading roller control motor 522 that drives the glue spreading roller 524.

The gluing mechanism 580 can move, as a whole, in the back-and-forth direction to spread gluea. A moving mechanism (not illustrated) moves the gluing mechanism 580 along a lower surface of the bookblock stack 540 which is gripped in an upright state by the gluing gripper 523 in a longitudinal direction.

As illustrated in FIG. 11, the gluing mechanism 580 starts moving from an initial position located at a rear side of the case bookbinding apparatus 500 and stops at a predetermined position located near a front side of the case bookbinding apparatus 500. During this forward movement, the gluing mechanism 580 does not apply any glue to the lower surface (i.e., spine portion) of the bookblock stack 540. Instead, the gluing mechanism 580 applies glue to the bookblock stack 540 when it returns to the rear side of the case bookbinding apparatus 500.

The gluing mechanism 580 moves upward after it has reached the predetermined position near the front side of the case bookbinding apparatus 500. The gluing mechanism 580 stops at a position where the glue spreading roller 524 can contact the lower surface of the bookblock stack 540. Then, the glue spreading roller 524 applies the glue on the lower surface of the bookblock stack 540, while the gluing mechanism 580 moves from the front side to the rear side of the case bookbinding apparatus 500.

Figure 12:
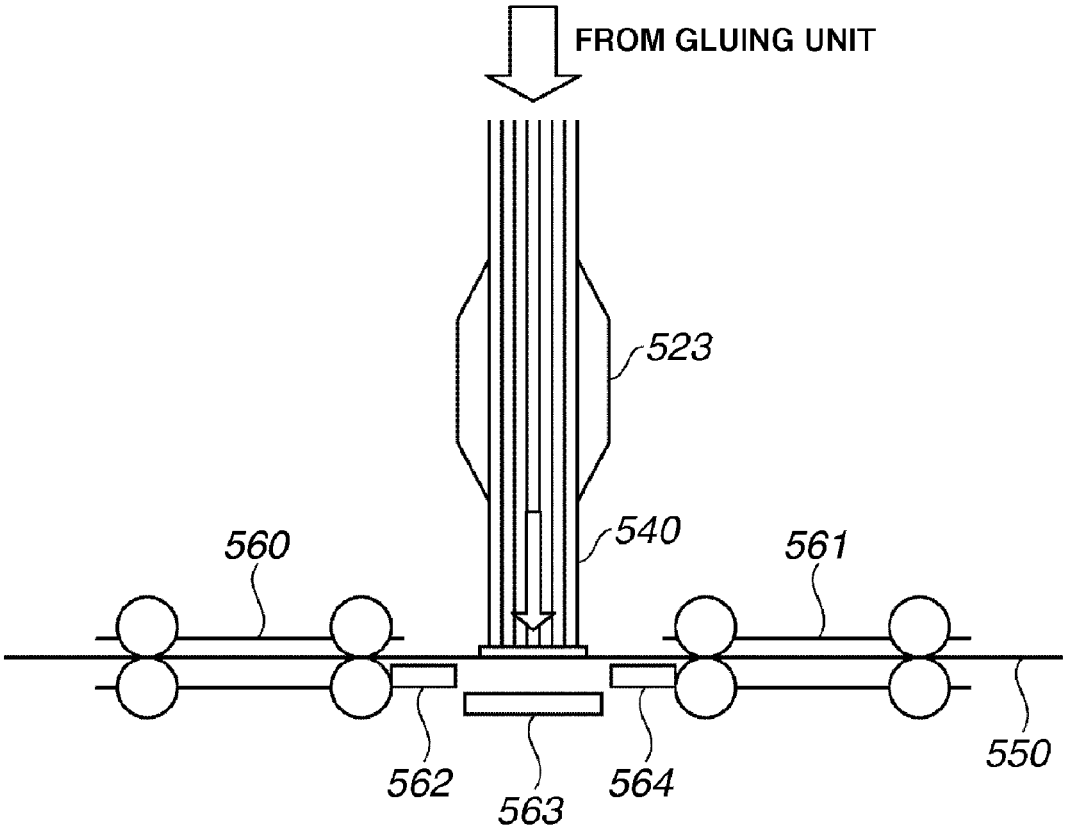
FIG. 12 illustrates an example operation flow in a bonding unit.

FIGS. 12 through 18 illustrate bonding operations performed by the bonding unit C. As illustrated in FIG. 12, a cover 550 delivered from the image forming apparatus 10 is guided by conveying guides 560 and 561 and stops at a predetermined position. Meanwhile, the bookblock stack 540 glued at the gluing processing is lowered from the gluing unit B in a state where the bookblock stack 540 is gripped by the gluing gripper 523. Then, a glue spread surface of the bookblock stack 540 is bonded with the cover 550 held in a horizontal direction. A pressing member 563 presses the cover 550 against the glue spread surface of the bookblock stack 540.

Figure 13:
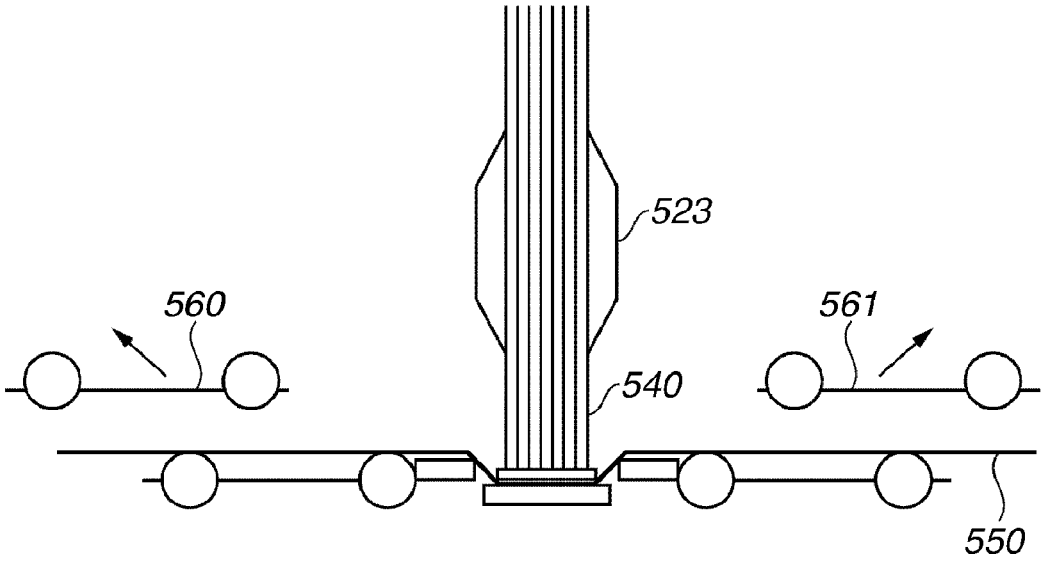
FIG. 13 illustrates an example operation flow in a bonding unit.

As illustrated in FIG. 13, upper parts of the conveying guides 560 561 move away before the pressing member 563 presses the glue spread surface of the bookblock stack 540 lowering downward. Thus, the conveying guides 560 and 561 do not interfere with the bookblock stack 540.

Figure 14:
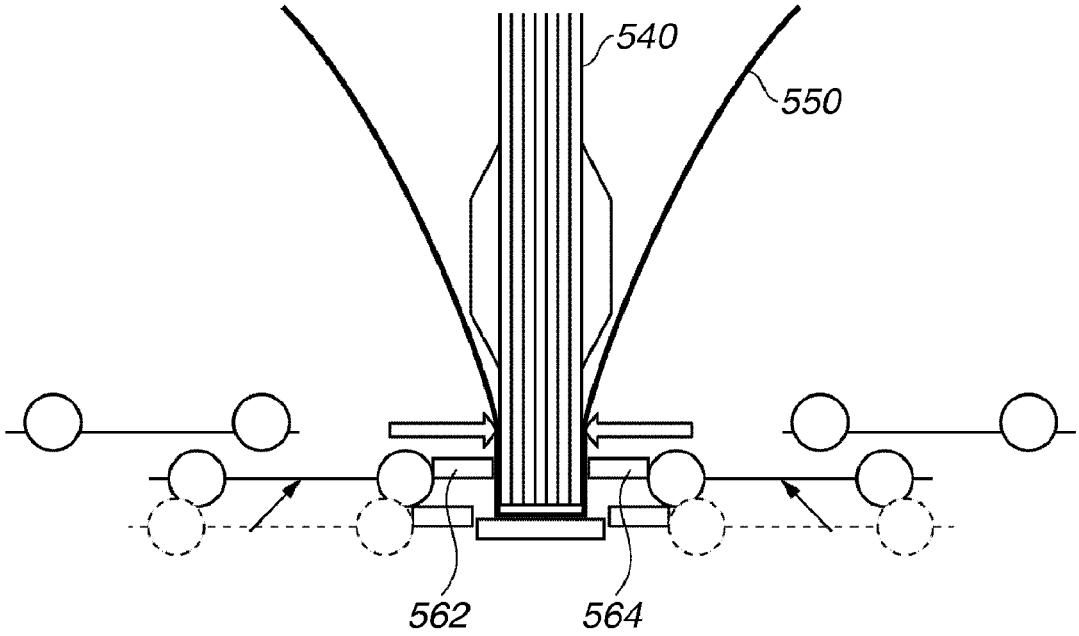
FIG. 14 illustrates an example operation flow in a bonding unit.

Next, as illustrated in FIG. 14, after the cover 550 contacts the bookblock stack 540, folding members 562 and 564, a lower part of the conveying guide 560, and a lower part of the conveying guide 561 move upward obliquely relative to the pressing member 563, as indicated by an arrow extending from a dotted line position to a solid line position. The folding members 562 and 564 raised in the upper oblique direction can press the cover 550 upward and bend the cover 550 along the corners (both edges) of the glue spread surface, thereby performing case processing for wrapping the bookblock stack 540 with the cover 550.

Figure 15:
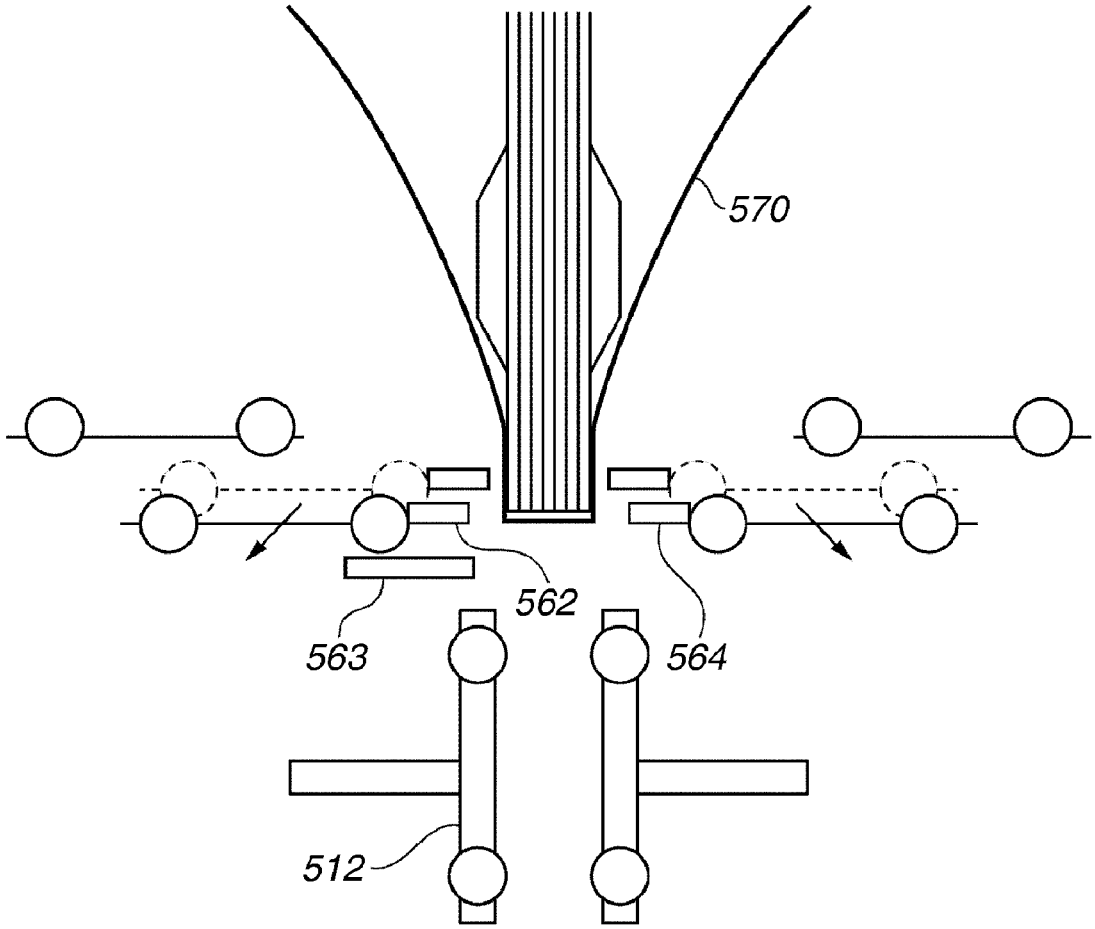
FIG. 15 illustrates an example operation flow in a bonding unit.

After the case processing is completed, as illustrated in FIG. 15, the folding members 562 and 564, the lower part of the conveying guide 560, and the lower part of the conveying guide 561 retract from a dotted line position to a solid line position. Furthermore, the pressing member 563 retracts in the horizontal direction to secure a space for the booklet 570 to move downward.

Figure 16:
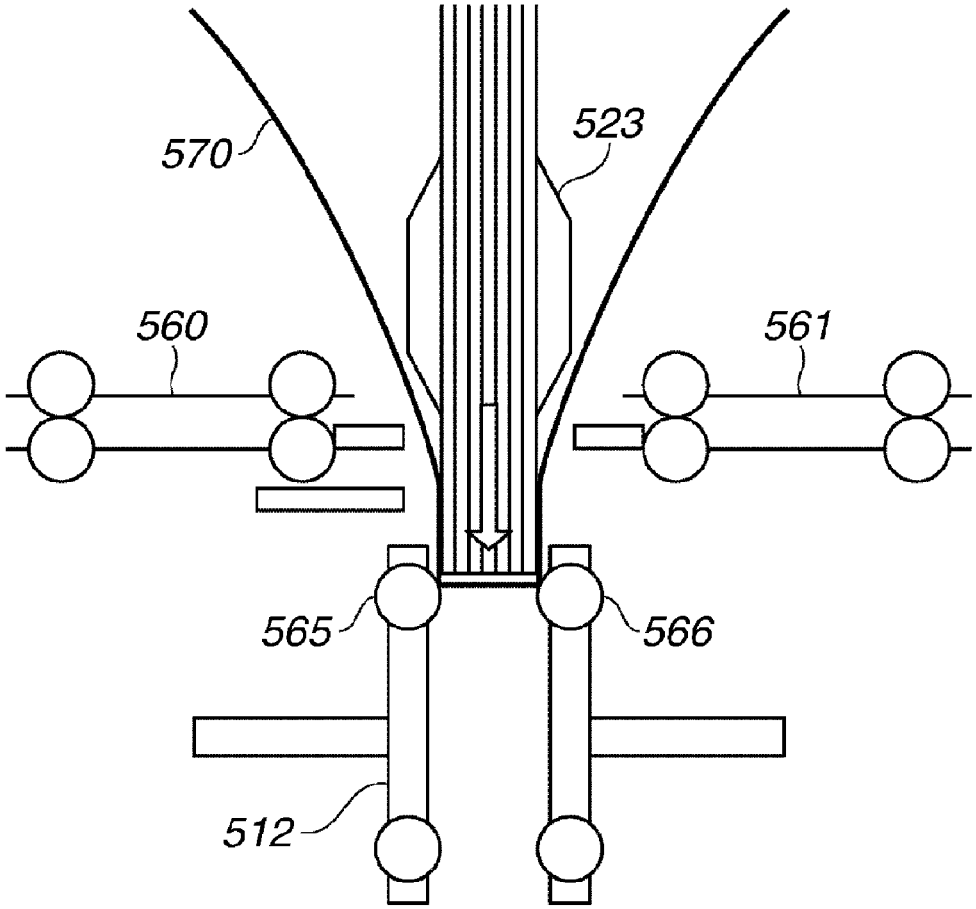
FIG. 16 illustrates an example operation flow in a bonding unit.
Figure 17:
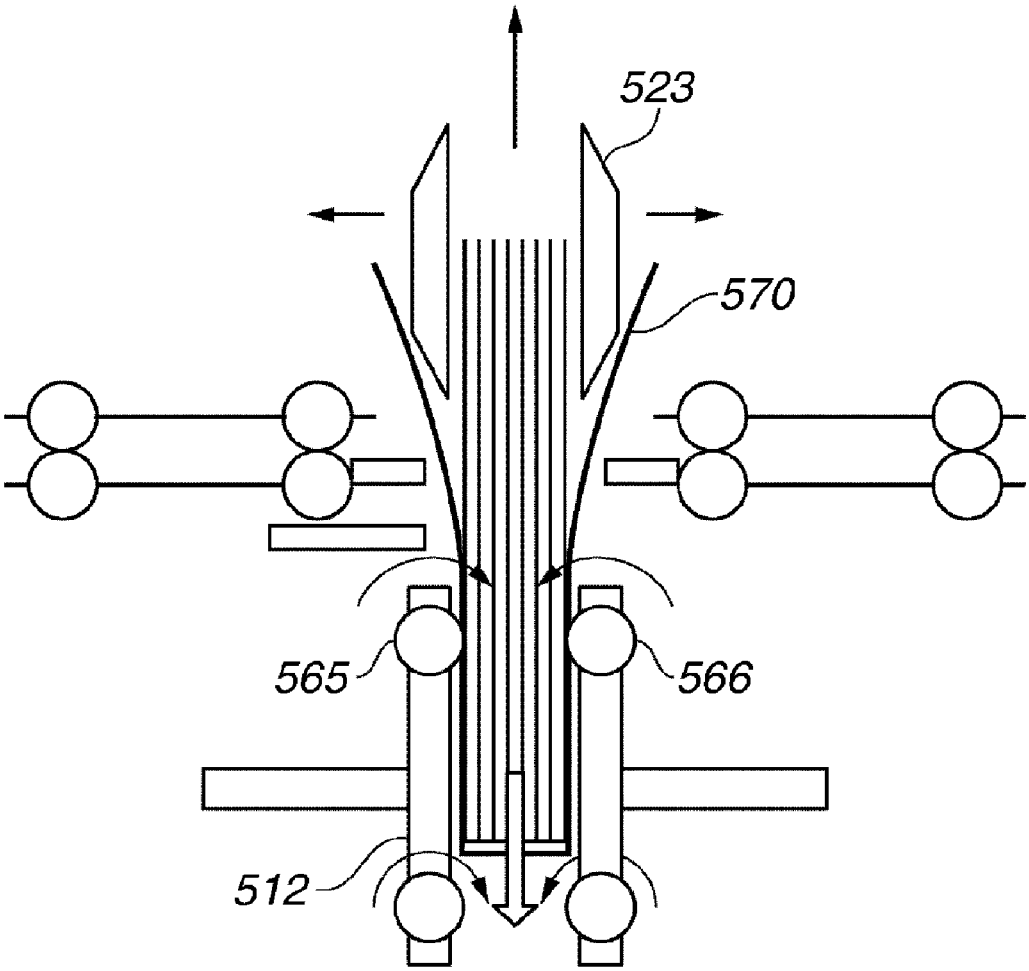
FIG. 17 illustrates an example operation flow in a bonding unit.

Next, as illustrated in FIG. 16, the gluing gripper 523 moves downward and transfers the booklet 570 to trim unit transfer rollers 565 and 566. Then, as illustrated in FIG. 17, the gluing gripper 523 releases the booklet 570. At the same time, the trim unit transfer rollers 565 and 566 convey the booklet 570 downward. Then, the trim unit transfer rollers 565 and 566 convey the booklet 570 to a predetermined position and stop the booklet 570.

Figure 18:
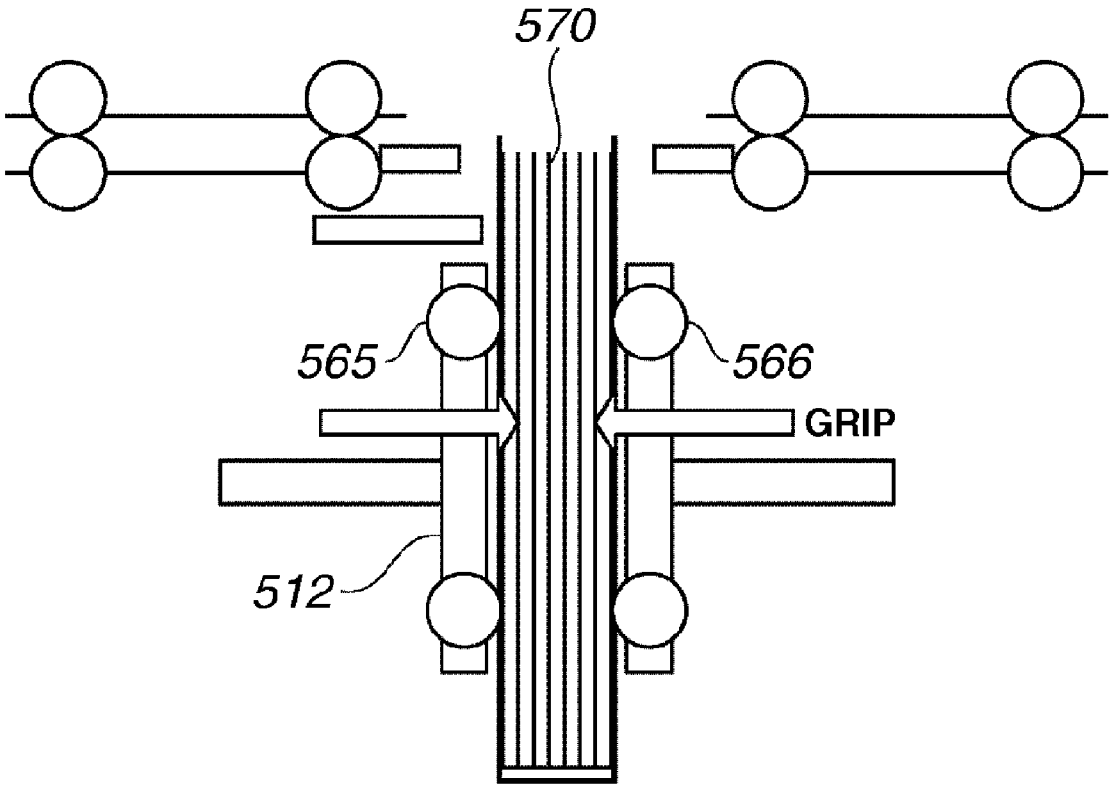
FIG. 18 illustrates an example operation flow in a bonding unit.

Then, as illustrated in FIG. 18, the trim gripper 512 grips the booklet 570 and lowers the booklet 570 to a position corresponding to the cutting unit D.

Figure 19:
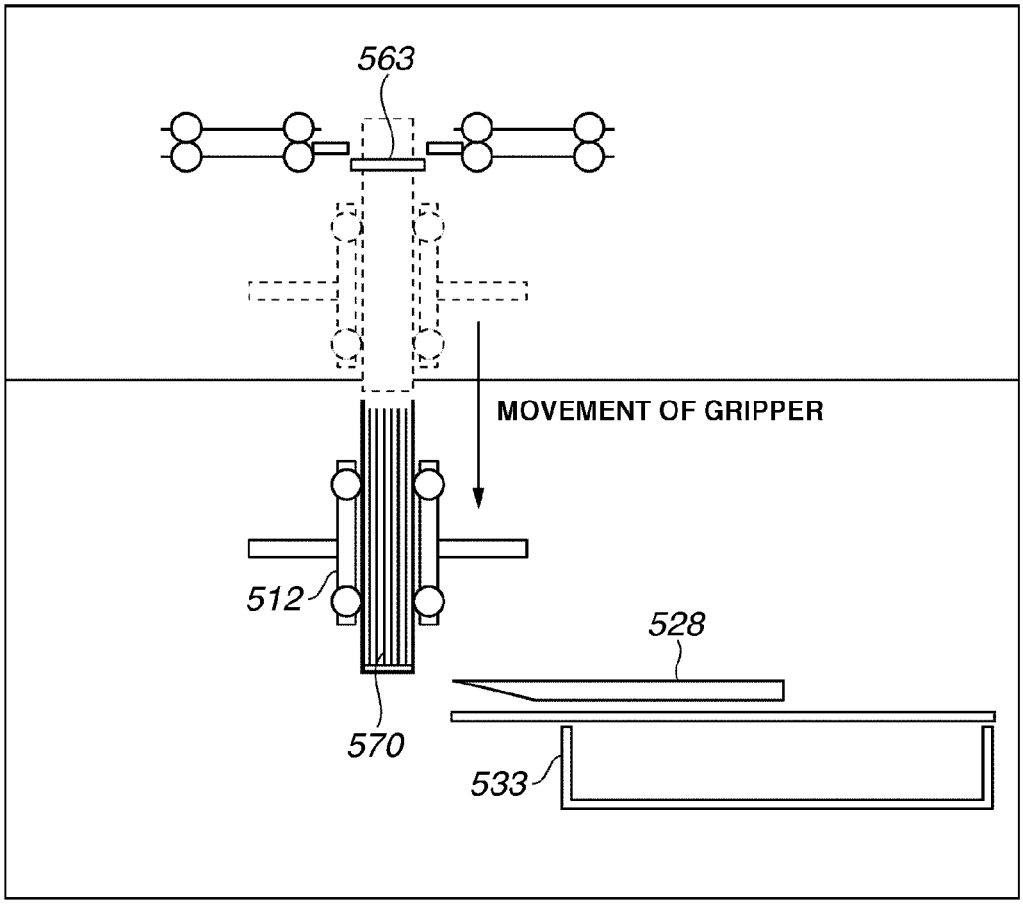
FIG. 19 illustrates an example operation flow in a cutting unit.

FIGS. 19 through 25 illustrate cutting operations performed by the cutting unit D. As illustrated in FIG. 19, after the bonding unit C forms the booklet 570 including the cover and the bookblock stack bonded together, the trim gripper 512 moves the booklet 570 to the cutting unit D. At this time, the pressing member 563 moves from the horizontally retracted position to a position where the bonded portion of the cover can be pressed. Then, the trim gripper 512, the cutter 528, and the waste receiver 533 cooperatively perform a cutting operation applied to front, top, and bottom edges of the booklet 570.

Figure 20:
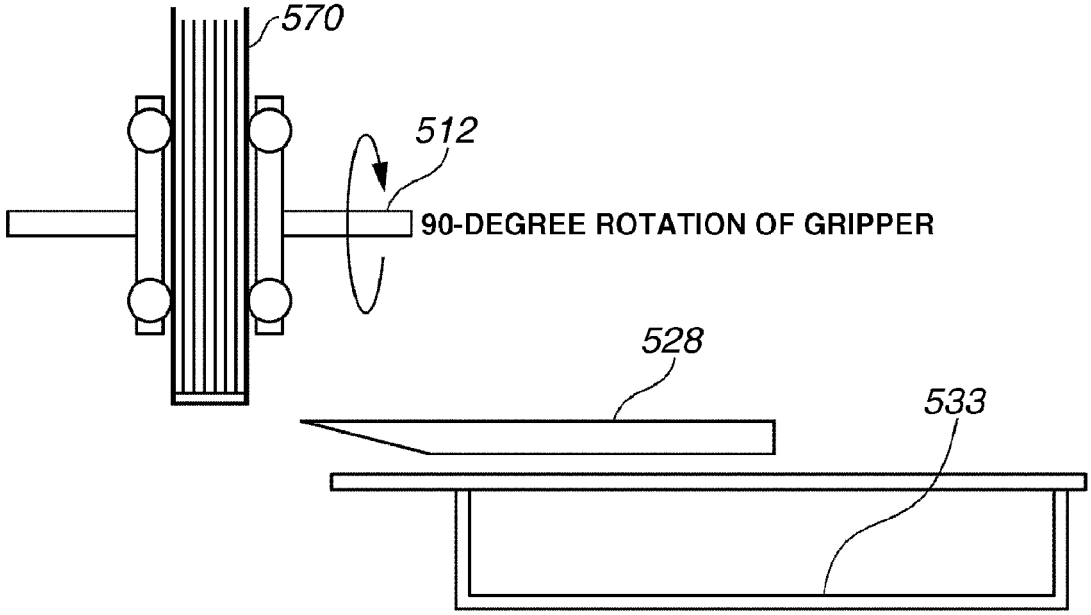
FIG. 20 illustrates an example operation flow in a cutting unit.

First, as illustrated in FIG. 20, when the booklet 570 arrives at the cutting unit D, the spine portion of the booklet 570 is positioned at the lower side. The trim gripper 512 rotates 90 degrees to change the orientation of the booklet 570 by an angle of 90 degrees.

Figure 21:
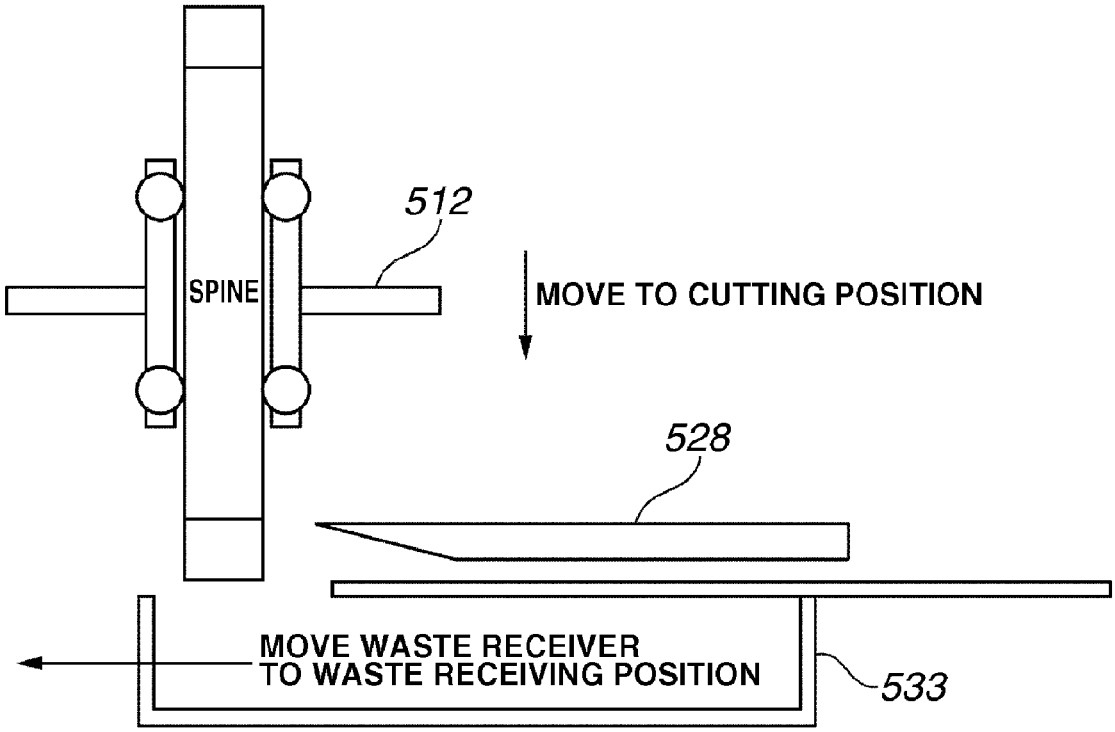
FIG. 21 illustrates an example operation flow in a cutting unit.
Figure 22:
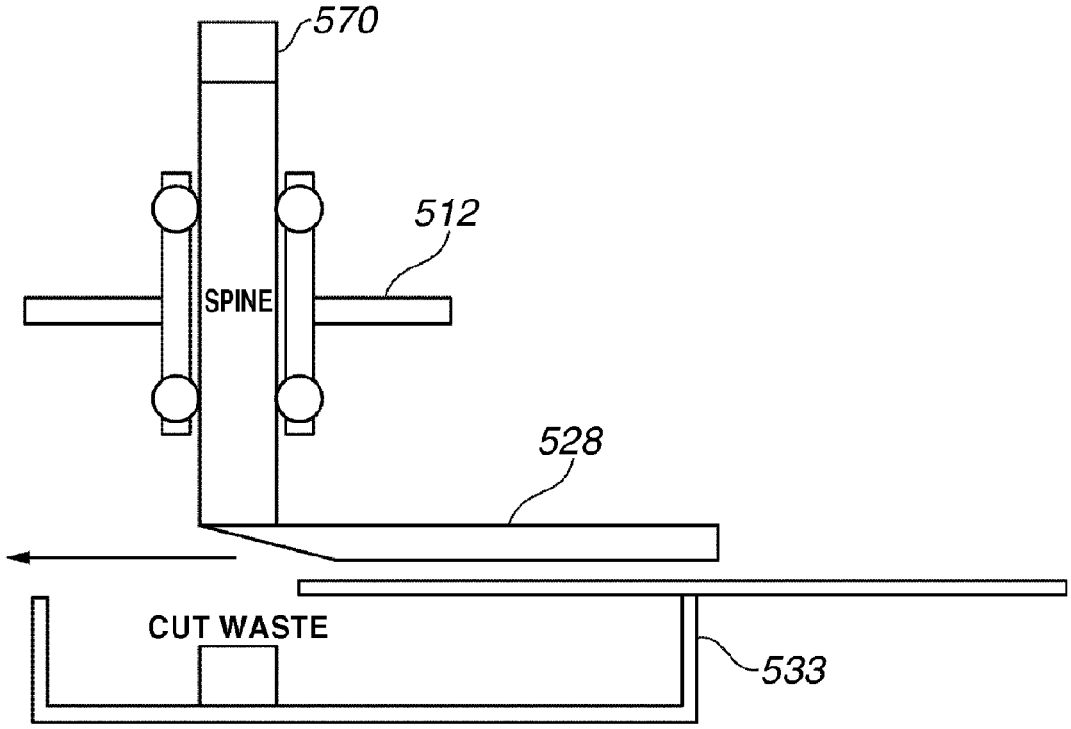
FIG. 22 illustrates an example operation flow in a cutting unit.
Figure 23:
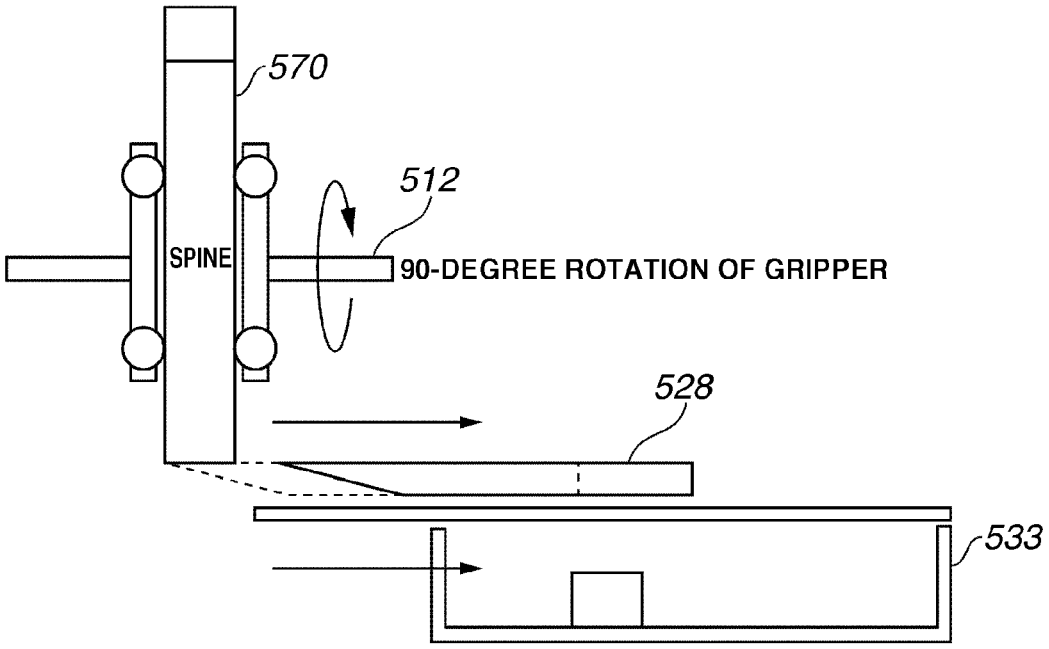
FIG. 23 illustrates an example operation flow in a cutting unit.

Next, as illustrated in FIG. 21, the waste receiver 533 moves toward at the bottom of the booklet 570. Then, as illustrated in FIG. 22, the cutter 528 further moves and cuts a bottom side of the booklet 570. The cut waste, generated in this state, can be stored in the cutting waste receiver 533 positioned under the booklet 570. Then, as illustrated in FIG. 23, the cutter 528 returns to its retracted position and the waste receiver 533 returns to its retracted position.

Next, the trim gripper 512 rotates 90 degrees in the same direction. The cutter 528 performs a cutting operation at a front edge of the booklet 570. Then, the trim gripper 512 further rotates 90 degrees in the same direction. The cutter 528 performs a cutting operation at a top side of the booklet 570. Thus, the cutting unit D finishes the cutting operation applied to the front, top, and bottom edges of the booklet 570.

Figure 24:
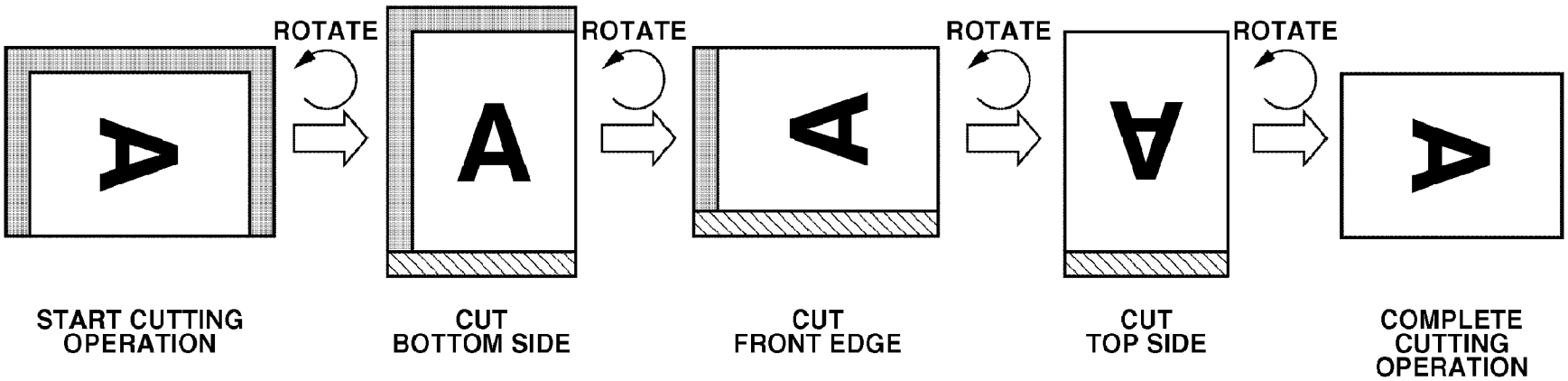
FIG. 24 illustrates an example operation flow in a cutting unit.

As illustrated in FIG. 24, after completing the cutting operation applied to the top side, the trim gripper 512 further rotates 90 degrees. Then, while holding the spine portion of the booklet 570 at the lower side, the booklet 570 is conveyed to the finished book discharge unit E.

Figure 25:
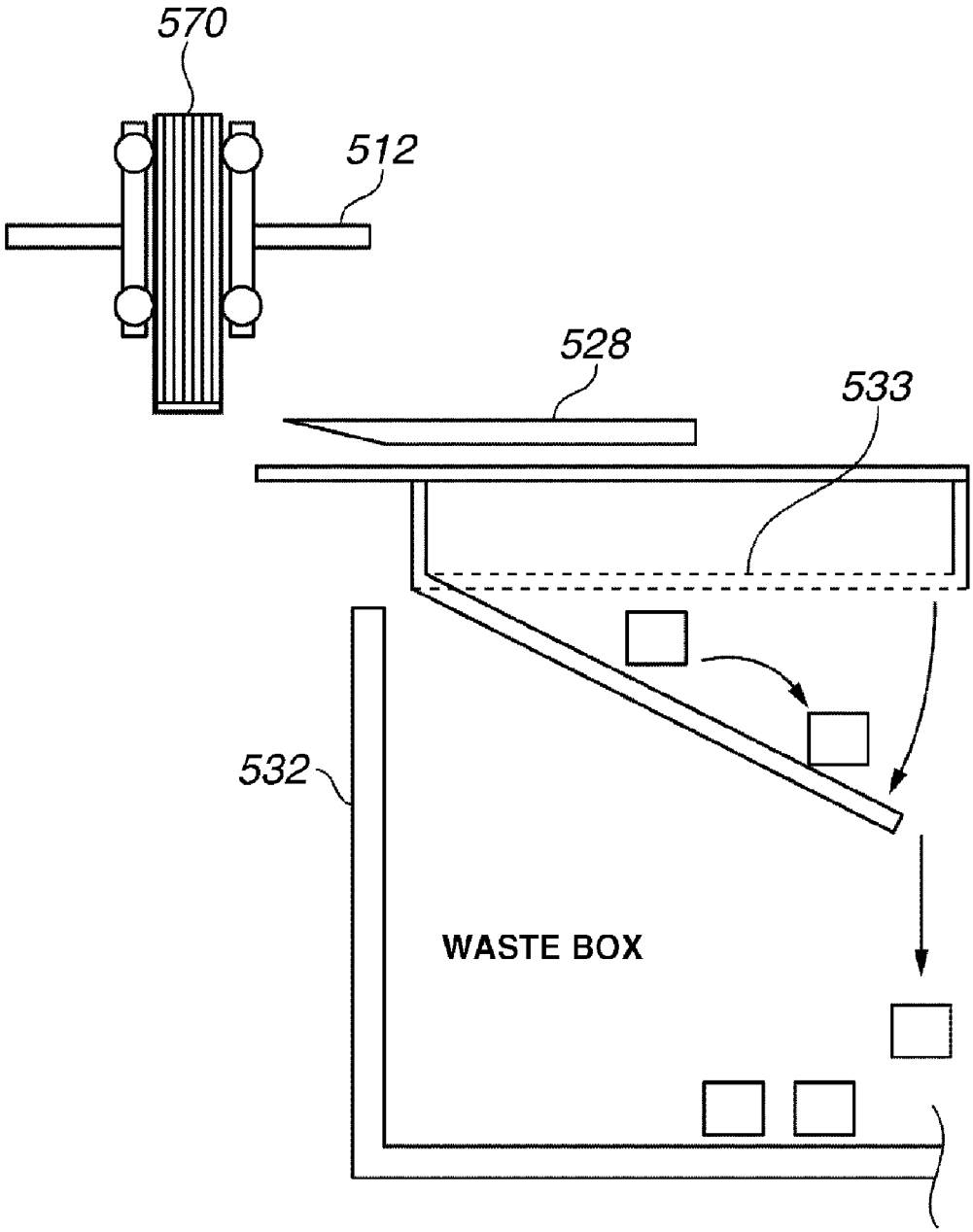
FIG. 25 illustrates an example operation flow in a cutting unit.

The waste receiver 533 moves back and forth between the retracted position where the cutter 528 is not in a cutting operation and a waste receiving position where the cutter 528 performs the cutting operation. The retracted position of the waste receiver 533 is just above the waste box 532. Furthermore, as illustrated in FIG. 25, the waste receiver 533 has a releasable bottom plate. When the waste receiver 533 reaches the retracted position, the waste receiver 533 opens the bottom plate and drops the stored cut waste into the waste box 532.

Figure 26:
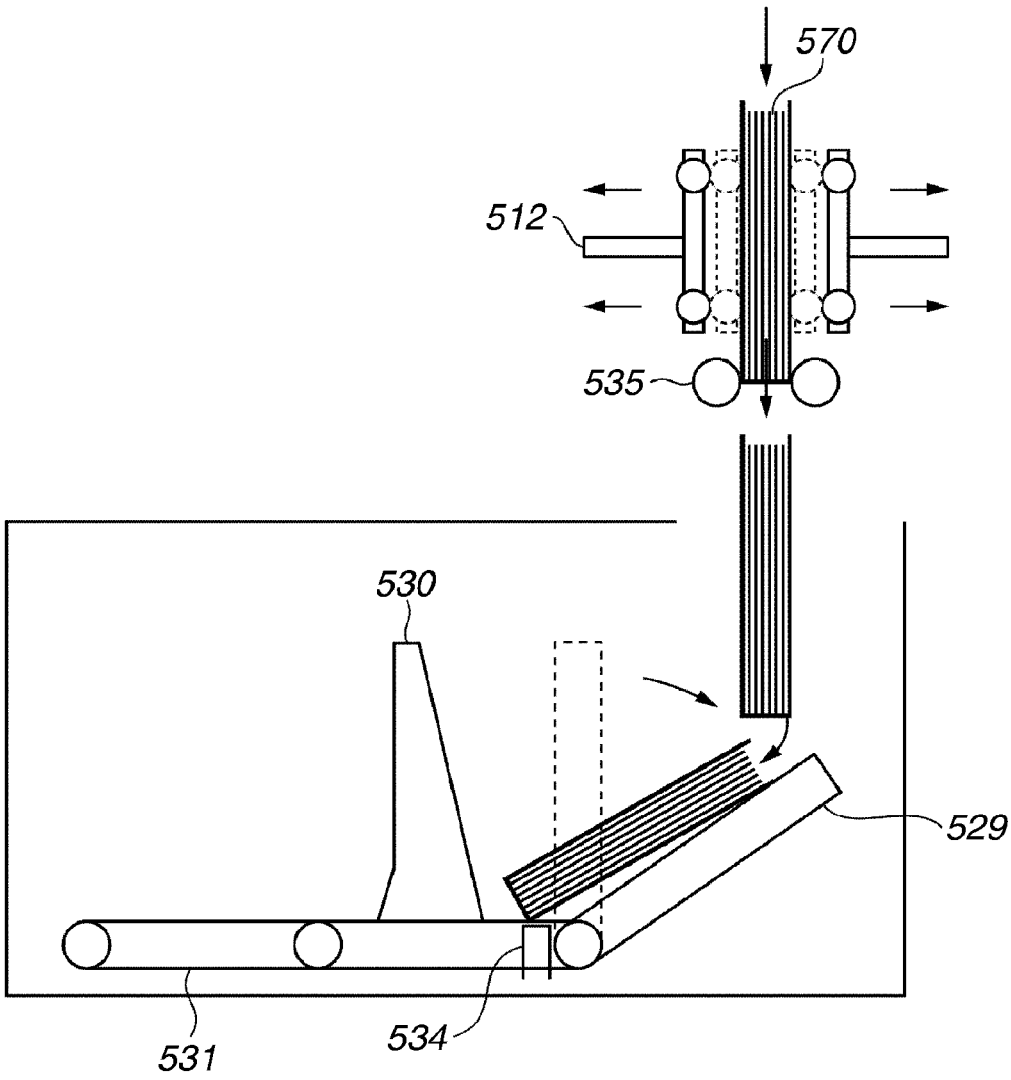
FIG. 26 illustrates an example operation flow in a finished book discharge unit.

FIGS. 26 through 29 illustrate discharge operations performed by the finished book discharge unit E. FIG. 26 illustrates a cross-sectional view of the finished book discharge unit E. After the cutting unit D completes the cutting of the booklet 570, the trim gripper 512 holding the booklet 570 moves downward until the booklet 570 reaches a conveyance roller pair 535. Then, the conveyance roller pair 535 conveys the booklet 570. The trim gripper 512 releases the booklet 570 and returns to a predetermined position in the bonding unit C. The booklet 570 conveyed by the conveyance roller pair 535 is put on a finished book loading board 529 which is laid at a right side in the finished book discharge unit E.

Figure 27:
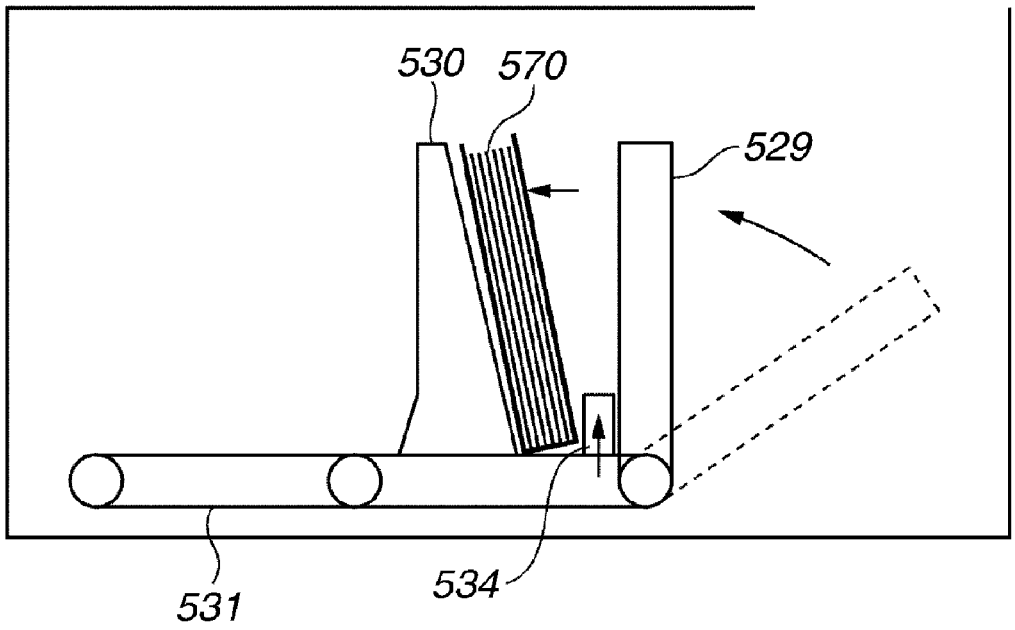
FIG. 27 illustrates an example operation flow in a finished book discharge unit.

Then, as illustrated in FIG. 27, the finished book loading board 529 rotates and stops at an upright position. A finished book supporting board 530 supports the booklet 570 in an upright state. A finished book stabilization board 534, which is positioned beneath a discharge conveyor belt 531, moves upward. The finished book supporting board 530 and the finished book stabilization board 534 cooperatively support the booklet 570.

Figure 28:
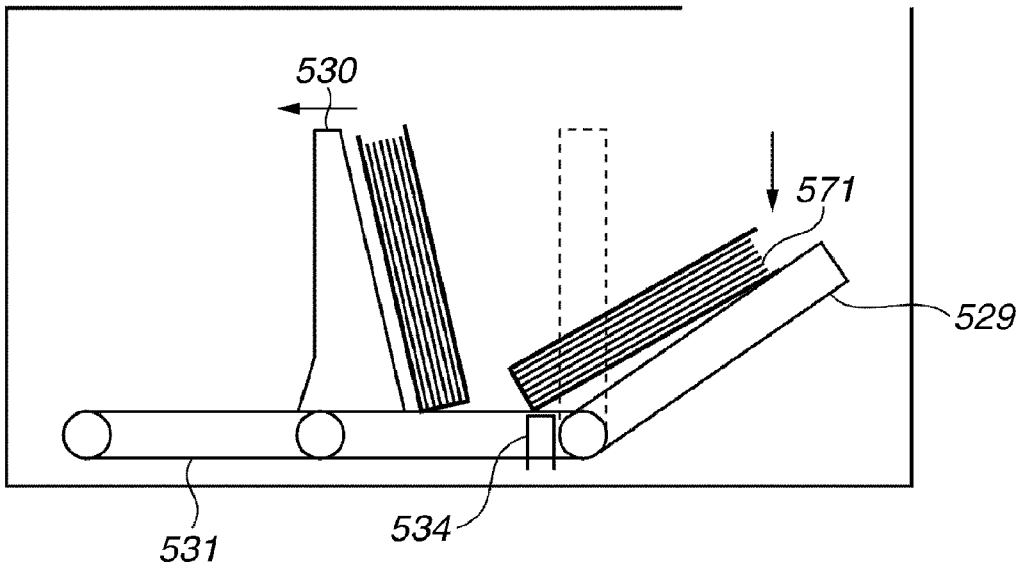
FIG. 28 illustrates an example operation flow in a finished book discharge unit
Figure 29:
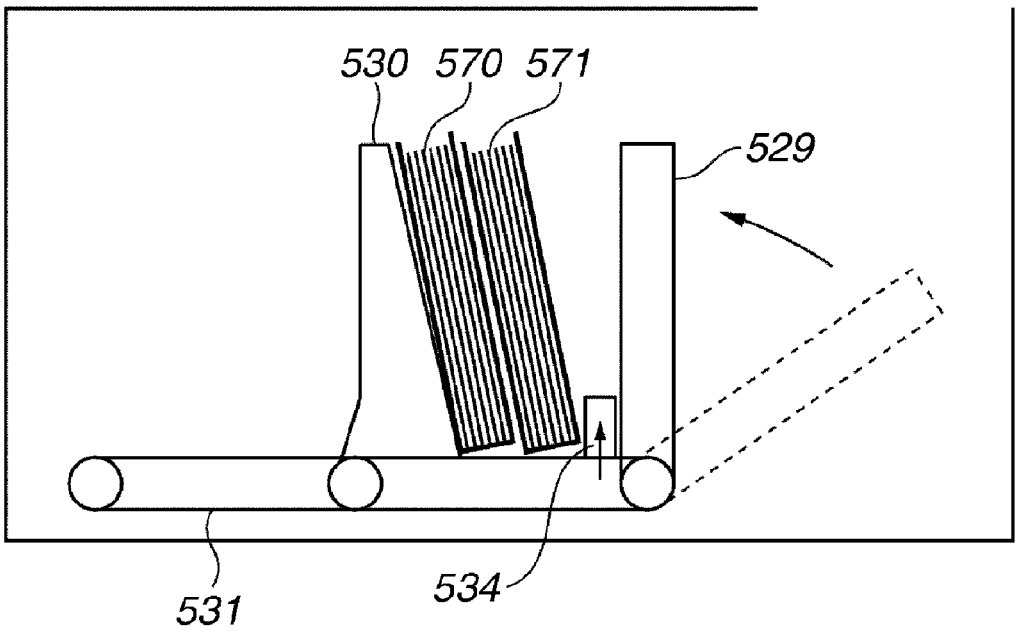
FIG. 29 illustrates an example operation flow in a finished book discharge unit

Then, as illustrated in FIG. 28, the discharge conveyor belt 531 moves the finished book supporting board 530 together with the booklet 570 leaning thereon to the left. Thus, a sufficient discharge space can be secured for a following booklet 571 to be conveyed from the cutting unit D. Namely, as illustrated in FIG. 29, the booklet 571 can be placed next to the booklet 570 and held in an upright state.

Figure 30:
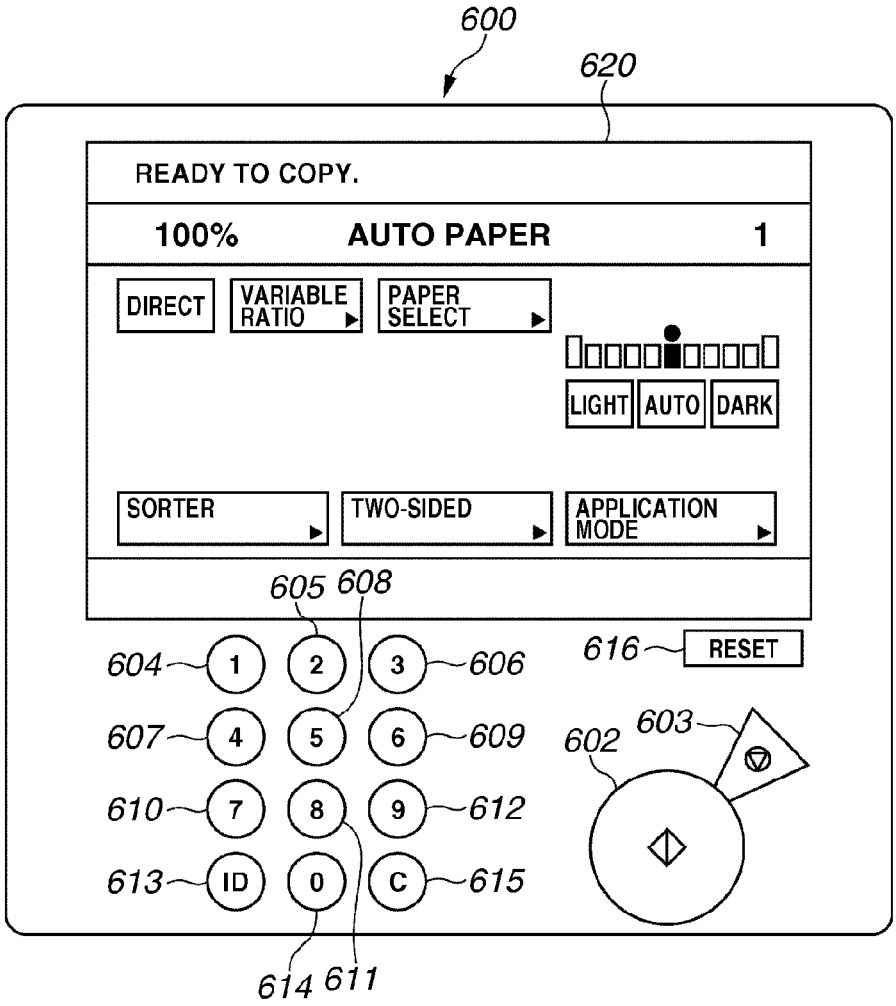
FIG. 30 illustrates an example operation display unit.

FIG. 30 illustrates the operation display unit 600 of the image forming apparatus 10. The operation display unit 600 includes a start key 602 to start an image forming operation, a stop key 603 to stop the image forming operation, and numeric keys 604 through 612 and 614 to input numeric data.

The operation display unit 600 further includes an identification (ID) key 613, a clear key 615, and a reset key 616. Moreover, the operation display unit 600 includes, at its upper part, a display unit 620 configured into a touch panel with soft keys formed on its screen.

For example, the image forming apparatus 10 includes various processing modes (e.g., a non-sort mode, a sort mode, and a bookbinding mode) corresponding to the post-processing performed in the finisher 400 and the case bookbinding apparatus 500. A user can set each processing mode by inputting via the operation display unit 600.

Figure 42:
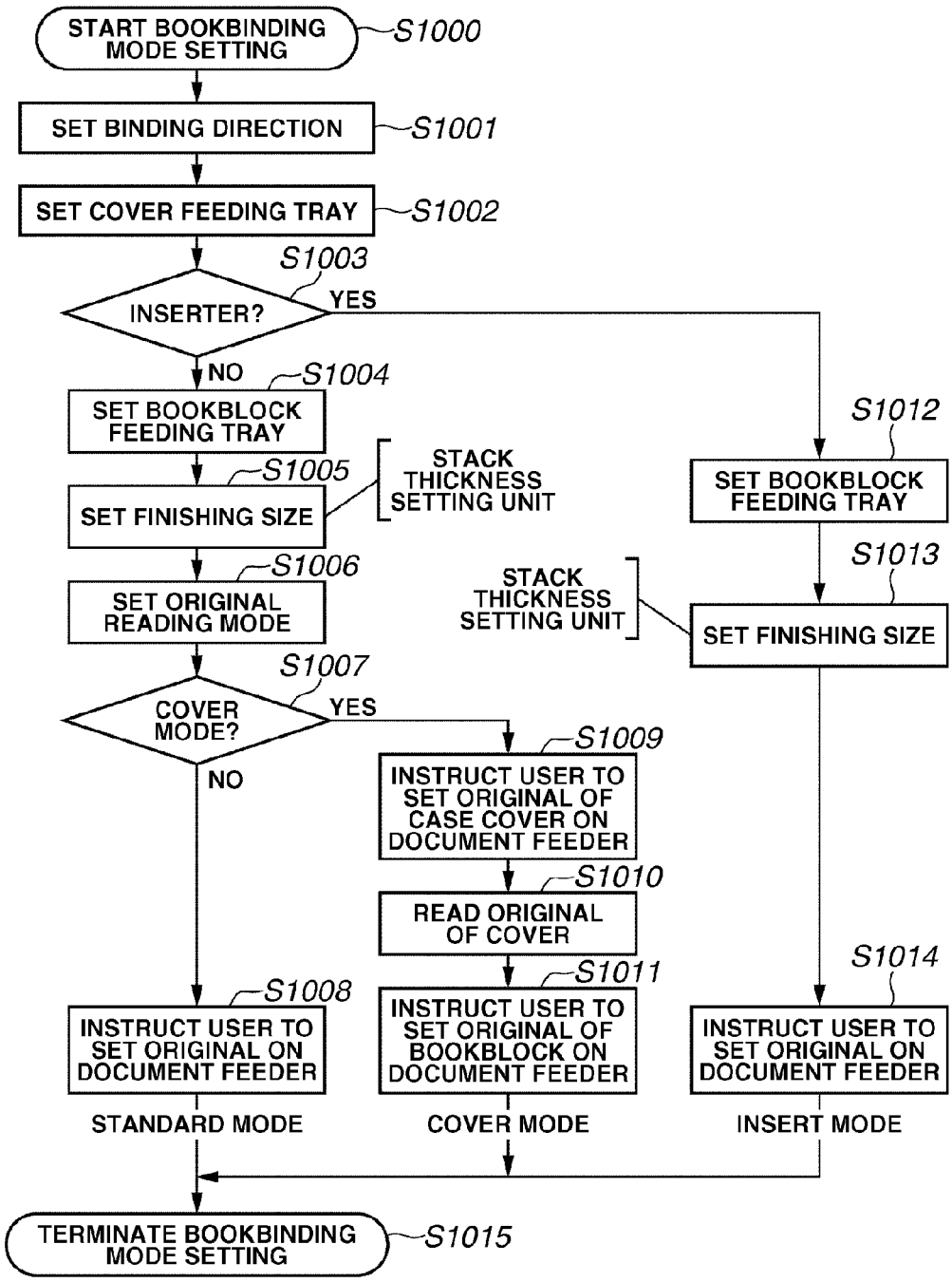
FIG. 42 is a flowchart illustrating example bookbinding mode setting processing.

Example bookbinding mode setting processing is described below with reference to a flowchart illustrated in FIG. 42 and drawings illustrated in FIGS. 31 through 41. The CPU 801 of the image forming apparatus 10 executes the processing illustrated in FIG. 42.

Figure 31:
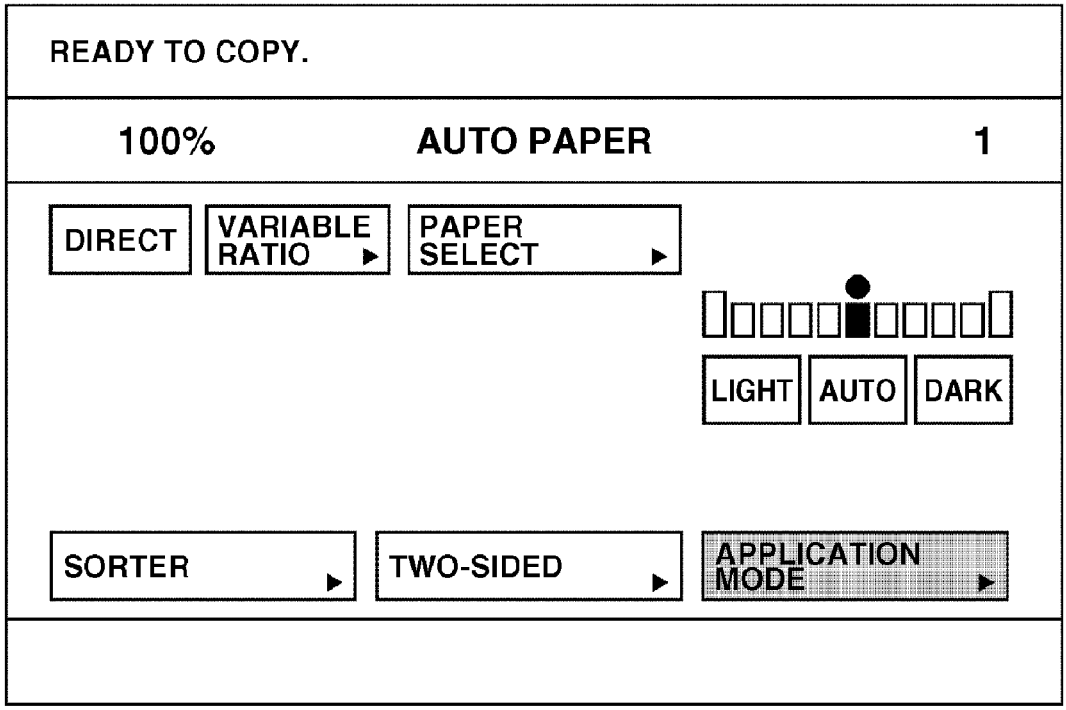
FIG. 31 illustrates an example bookbinding mode setting screen to set a mode.
Figure 32:
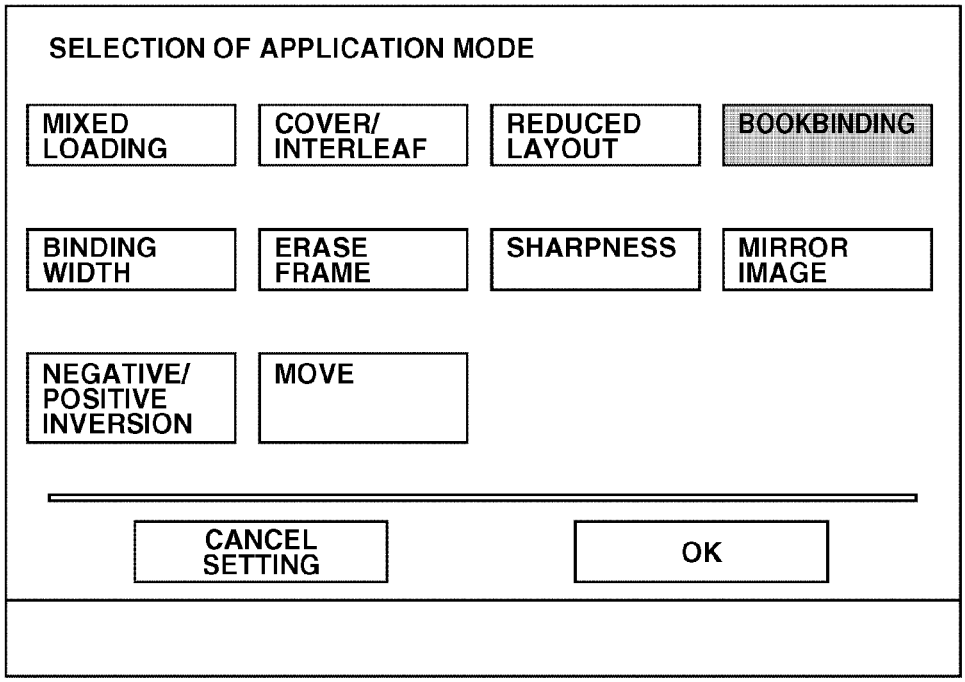
FIG. 32 illustrates an example bookbinding mode setting screen to set a mode.

If a user selects an "application mode" key on an initial screen illustrated in FIG. 31, the CPU 801 causes the display unit 620 to display a screen of an application mode menu illustrated in FIG. 32. If a user selects a "bookbinding" key from the application mode menu illustrated in FIG. 32, the CPU 801 causes the display unit 620 to display a screen illustrated in FIG. 33. Namely, in step S1000, the CPU 801 starts bookbinding mode setting processing.

Figure 33:
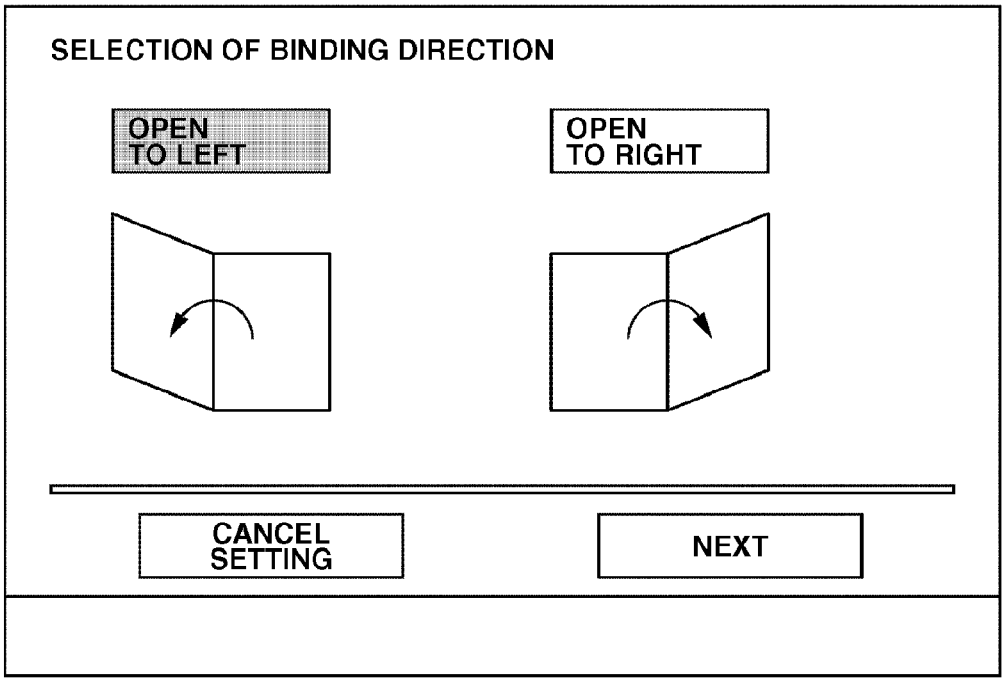
FIG. 33 illustrates an example bookbinding mode setting screen to set a mode.

The screen illustrated in FIG. 33 enables a user to select "open to right" or "open to left" as binding direction of a bookbinding product. At step S1001, the CPU 801 sets the binding direction according to a user's selection between "open to right" and "open to left."

Figure 34:
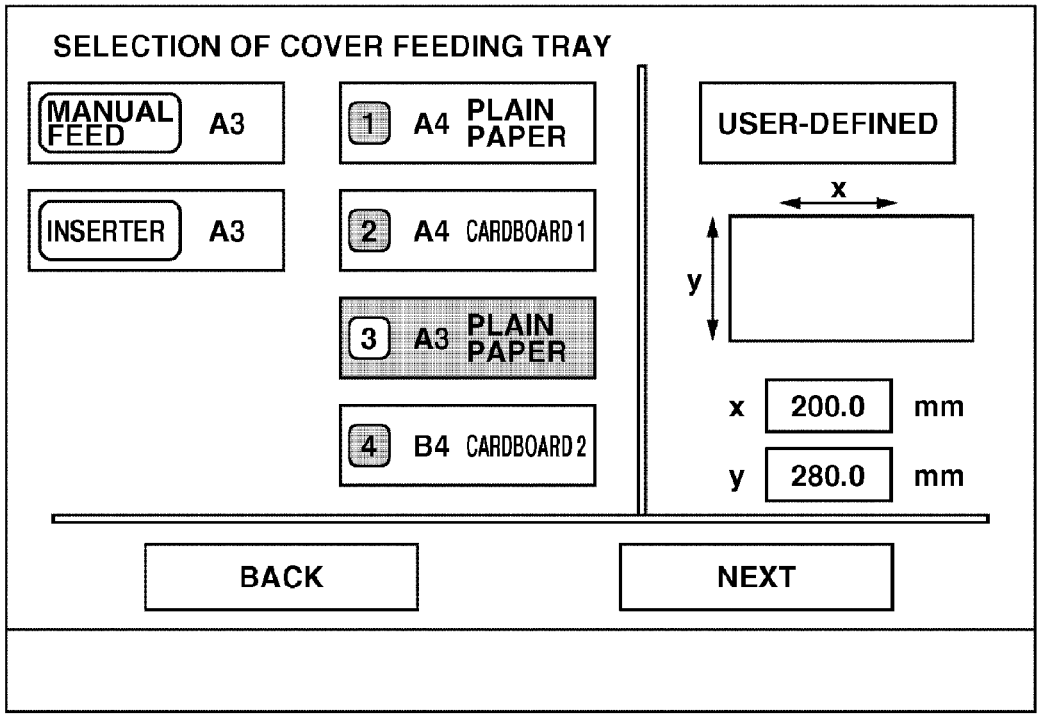
FIG. 34 illustrates an example bookbinding mode setting screen to set a mode.

Then, if a user presses a "next" key on the screen illustrated in FIG. 33, the CPU 801 causes the display unit 620 to display a screen illustrated in FIG. 34. The screen illustrated in FIG. 34 enables a user to select a paper feeding tray to feed a case cover. At step S1002, the CPU 801 sets a cover feeding tray according to a user's selection of the paper feeding tray.

The screen illustrated in FIG. 34 enables a user to select a paper feeding tray of the case cover from a plurality of paper feeding cassettes and an inserter. Furthermore, the screen illustrated in FIG. 34 enables a user to designate arbitrary dimensions as user-defined size. If a user presses a "next" key on the screen illustrated in FIG. 34, the CPU 801 determines whether the selected cover feeding tray is the inserter in step S1003.

If the selected cover feeding tray is not the inserter (NO in step S1003), the processing flow proceeds to step S1004. In this case, the CPU 801 causes the display unit 620 to display a screen illustrated in FIG. 35. The screen illustrated in FIG. 35 enables a user to select a paper feeding tray for a bookblock to be wrapped in the case cover. At step S1004, the CPU 801 performs setting of a bookblock paper feeding tray according to a user's selection input via the screen illustrated in FIG. 35.

Figure 35:
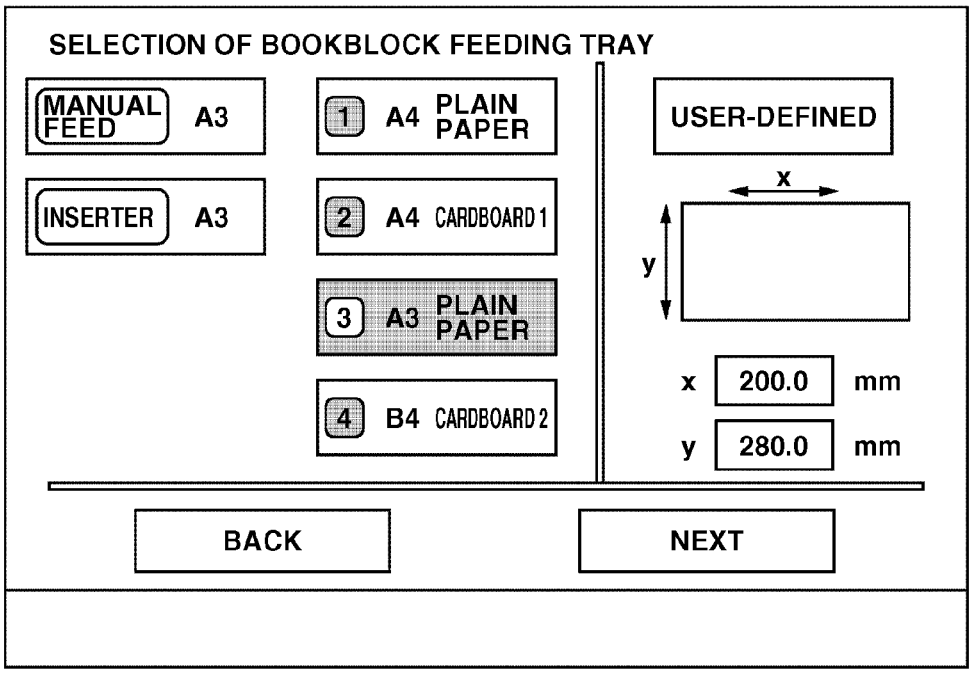
FIG. 35 illustrates an example bookbinding mode setting screen to set a mode.

The screen illustrated in FIG. 35 enables a user to designate arbitrary dimensions as user-defined size. If a user presses a "next" key on the screen illustrated in FIG. 35, the CPU 801 causes the display unit 620 to display a screen illustrated in FIG. 36.

Figure 36:
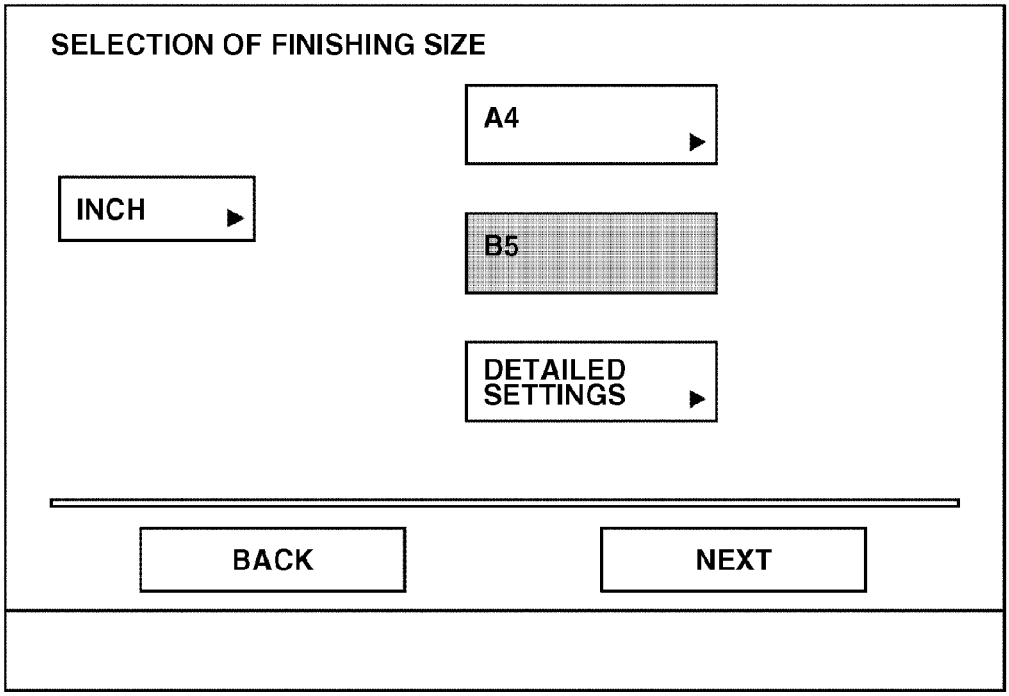
FIG. 36 illustrates an example bookbinding mode setting screen to set a mode.
Figure 37:
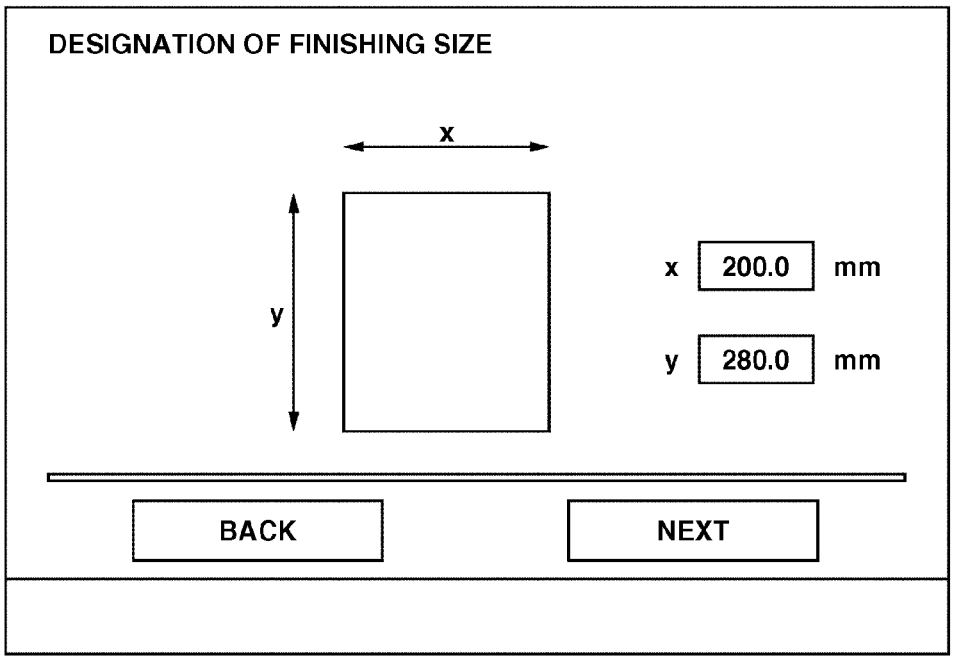
FIG. 37 illustrates an example bookbinding mode setting screen to set a mode.

The screen illustrated in FIG. 36 enables a user to select a finishing size from a plurality of regulated sizes. If a user presses a "detailed setting" key on the screen illustrated in FIG. 36, the CPU 801 causes the display unit 620 to display a screen illustrated in FIG. 37. The screen illustrated in FIG. 37 enables a user to designate arbitrary dimensions as finishing size. At step S1005, the CPU 801 sets the finishing size according to a user's designation input via the screen illustrated in FIG. 36 or FIG. 37.

Figure 38:
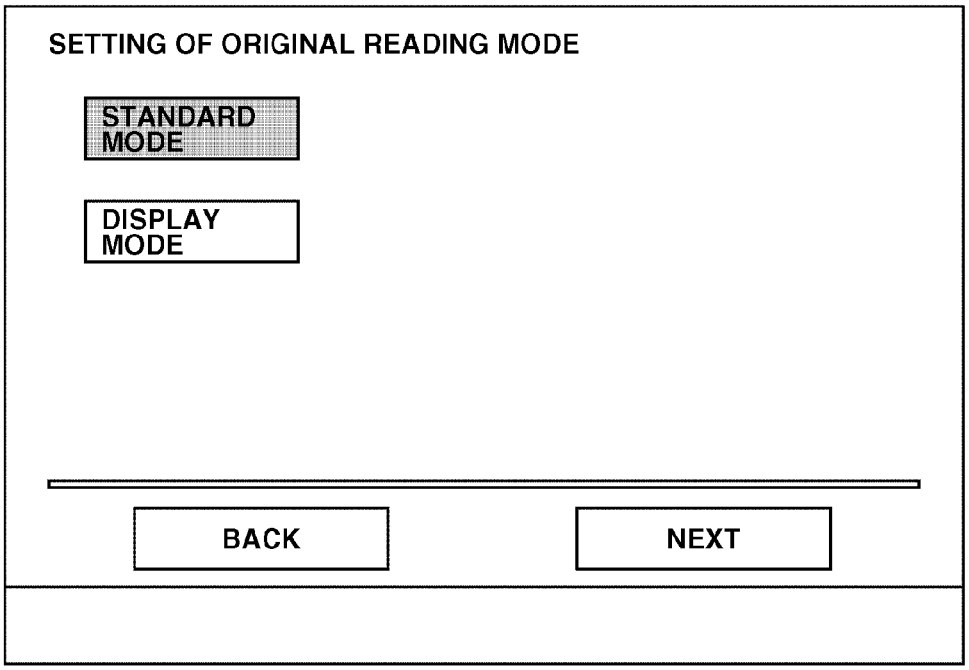
FIG. 38 illustrates an example bookbinding mode setting screen to set a mode.
Figure 39:
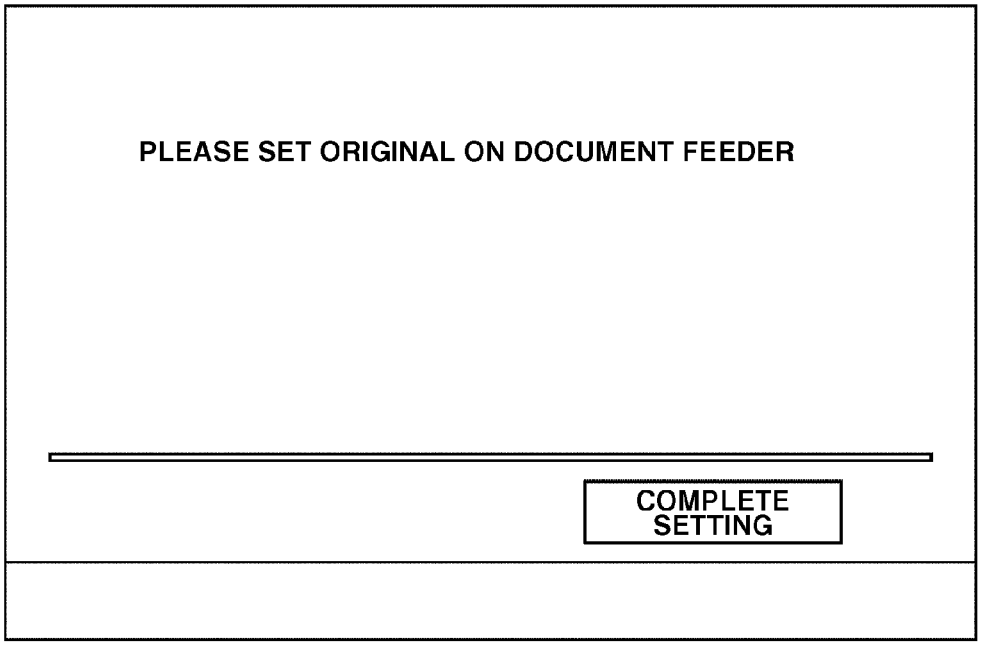
FIG. 39 illustrates an example bookbinding mode setting screen to set a mode.
Figure 40:
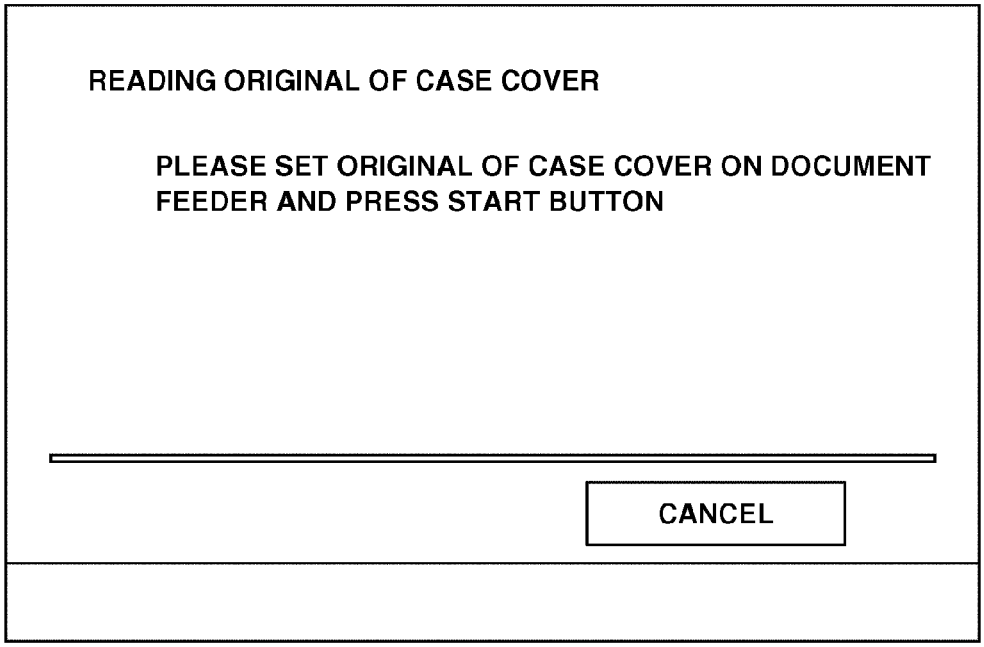
FIG. 40 illustrates an example bookbinding mode setting screen to set a mode.
Figure 41:
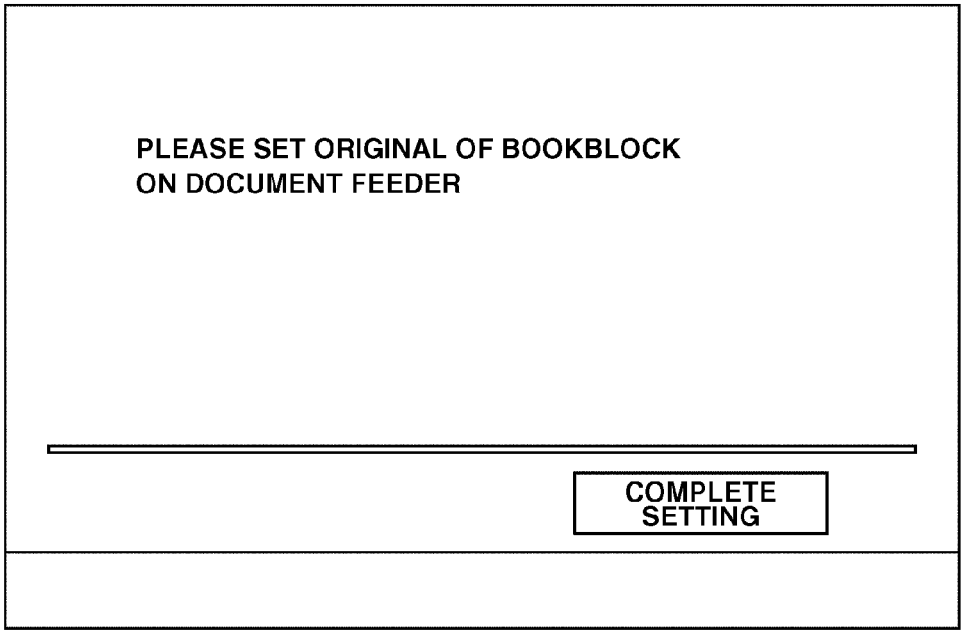
FIG. 41 illustrates an example bookbinding mode setting screen to set a mode.

After completing the setting of the finishing size, the CPU 801 causes the display unit 620 to display a screen illustrated in FIG. 38. The screen illustrated in FIG. 38 enables a user to select a "standard mode" or a "cover mode" as original reading mode. For example, if the original of a case cover is separated from an original of a bookblock, a user can designate the "cover mode." If the original of a front cover/rear cover and the original of a bookblock are integrated together as one stack, a user can designate the "standard mode."

At step S1006, the CPU 801 sets the original reading mode according to a user's selection. Next, at step S1007, the CPU 801 determines whether the selected reading mode is a "cover mode."

If the selected reading mode is not the "cover mode" (NO in step S1007), the processing flow proceeds to step S1008. At step S1008, the CPU 801 causes the display unit 620 to display a screen illustrated in FIG. 39 that instructs a user to set the original on the document feeder 100. Then, at step S1015, the CPU 801 terminates the bookbinding mode setting processing. Hereinafter, if a user sets the "standard mode" as original reading mode and instructs a bookbinding operation, this mode can be referred to as "standard mode."

If the selected reading mode is the "cover mode" (YES in step S1007), the processing flow proceeds to step S1009. At step S1009, the CPU 801 causes the display unit 620 to display a screen illustrated in FIG. 40 that instructs a user to set the original of the case cover on the document feeder 100 and press the start key 602. If a user presses the start key 602 on the operation display unit 600 illustrated in FIG. 30, the processing flow proceeds to step S1010. At step S1010, the CPU 801 starts reading the original of the cover.

After completing the reading operation of the original of the cover, the processing flow proceeds to step S1011. At step S1011, the CPU 801 causes the display unit 620 to display a screen illustrated in FIG. 41 that instructs a user to set the original of the bookblock on the document feeder 100. Then, at step S1015, the CPU 801 terminates the bookbinding mode setting processing. Hereinafter, if a user sets the "cover mode" as original reading mode and instructs a bookbinding operation, this mode can be referred to as "cover mode."

If the inserter is selected to the cover feeding tray (YES in step S1003), the processing flow proceeds to step S1012. At step S1012, the CPU 801 causes the display unit 620 to display the screen illustrated in FIG. 35 that enables a user to perform the above-described bookblock paper feeding tray setting processing.

After completing the bookblock paper feeding tray setting processing, the processing flow proceeds to step S1013. At step S1013, the CPU 801 causes the display unit 620 to display the screen illustrated in FIG. 36 that enables a user to perform the above-described finishing size setting processing. If a user presses the "detailed setting" key on the screen illustrated in FIG. 36, the CPU 801 causes the display unit 620 to display the screen illustrated in FIG. 37 that enables the user to designate an arbitrary finishing size.

After completing the finishing size setting processing, the processing flow proceeds to step S1014. At step S1014, the CPU 801 causes the display unit 620 to display the screen illustrated in FIG. 39 that instructs a user to set the original on the document feeder 100. Then, at step S1015, the CPU 801 terminates the bookbinding mode setting processing. Hereinafter, if a user designates the inserter as cover feeding tray and performs a bookbinding operation, this mode can be referred to as "insert mode."

Figure 5:
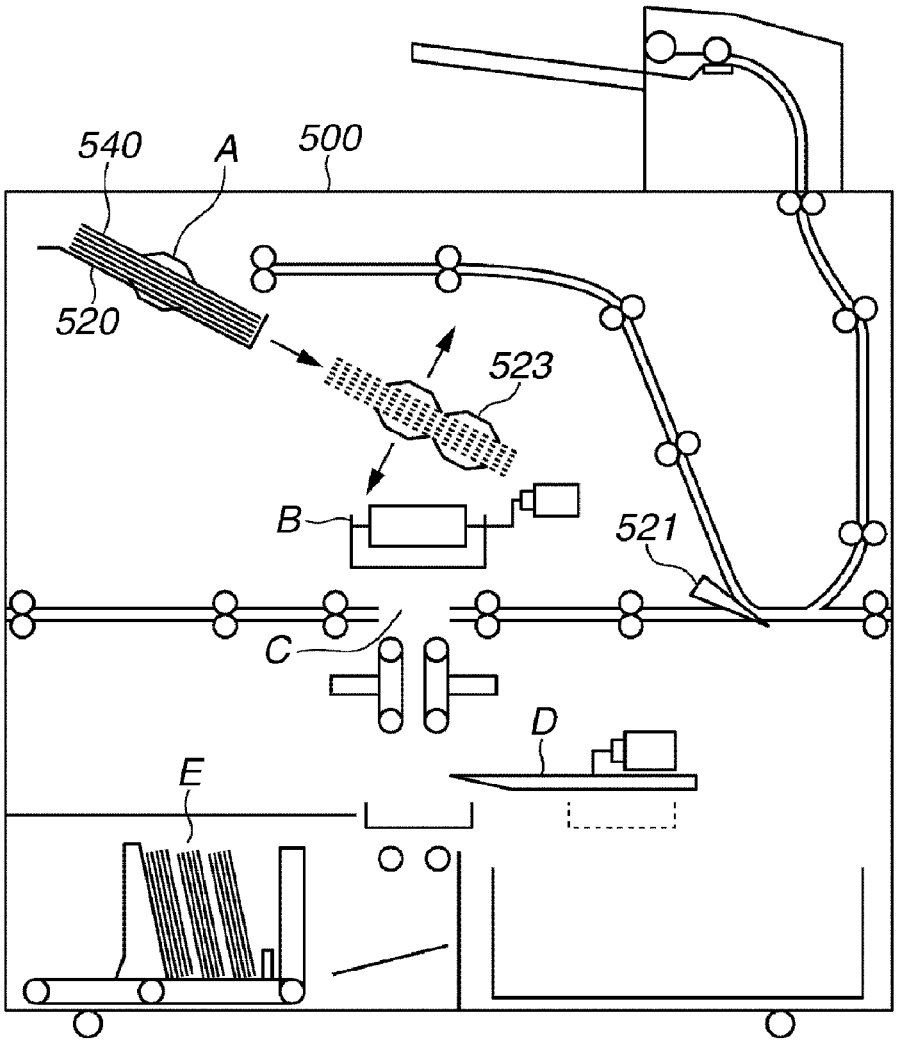
FIG. 5 illustrates an example paper flow in a case bookbinding apparatus.

A stack thickness detection unit 912 is described below with reference to FIG. 5. The bookblock loading unit A can detect a stack thickness. More specifically, if all of the recording sheets to be integrated as bookblock have been discharged to the loading tray 520, the gluing gripper 523 grips the bookblock stack 540. A movement amount of the gluing gripper 523 during this grip operation is variable according to the stack thickness of the bookblock stack 540. Therefore, the stack thickness detection unit 912 can calculate the stack thickness of the bookblock stack 540 based on the movement amount of the gluing gripper 523. The cover length calculation unit 913 can use a detection result (i.e., stack thickness of the bookblock stack 540) obtained by the stack thickness detection unit 912.

The cover length calculation unit 913 is described below. As described above, the screens illustrated in FIGS. 34 through 37 enable a user to set various sizes for a bookbinding operation. A user can fix a cover size by selecting a cover feeding tray on the screen illustrated in FIG. 34. Furthermore, a user can fix a bookblock size by setting a bookblock paper feeding tray on the screen illustrated in FIG. 35. Furthermore, a user can fix a finishing size via the finishing size selection screen illustrated in FIG. 36 or 37. The communication IF 807 transmits setting values of various sizes to the case bookbinding apparatus 500.

In an exemplary embodiment, the cutting amounts of the top, bottom and the front edge directions can be calculated based on a relationship between the bookblock size and the finishing size. In this respect, the finishing size information is equivalent to bookblock cutting amount information.

The cover length calculation unit 913 calculates a cover length of a bookbinding product based on a stack thickness value detected by the stack thickness detection unit 912 and a cover size setting value notified from the communication IF 807, according to the following formula (1).

$$\text{Cover length}=(\text{cover size setting value in front edge direction}-\text{stack thickness value})/2 \quad (1)$$

The cover cutting amount calculation unit 914 calculates a cover cutting amount in the front edge direction based on the cover length calculated by the cover length calculation unit 913 and a finishing size setting value notified from the communication IF 807, according to the following formula (2). The bookbinding permission/inhibition determination unit 915 uses a calculation result obtained by the cover cutting amount calculation unit 914.

$$\text{Cover cutting amount}=\text{cover length}-\text{finishing size setting value in front edge direction} \quad (2)$$

Figure 43:
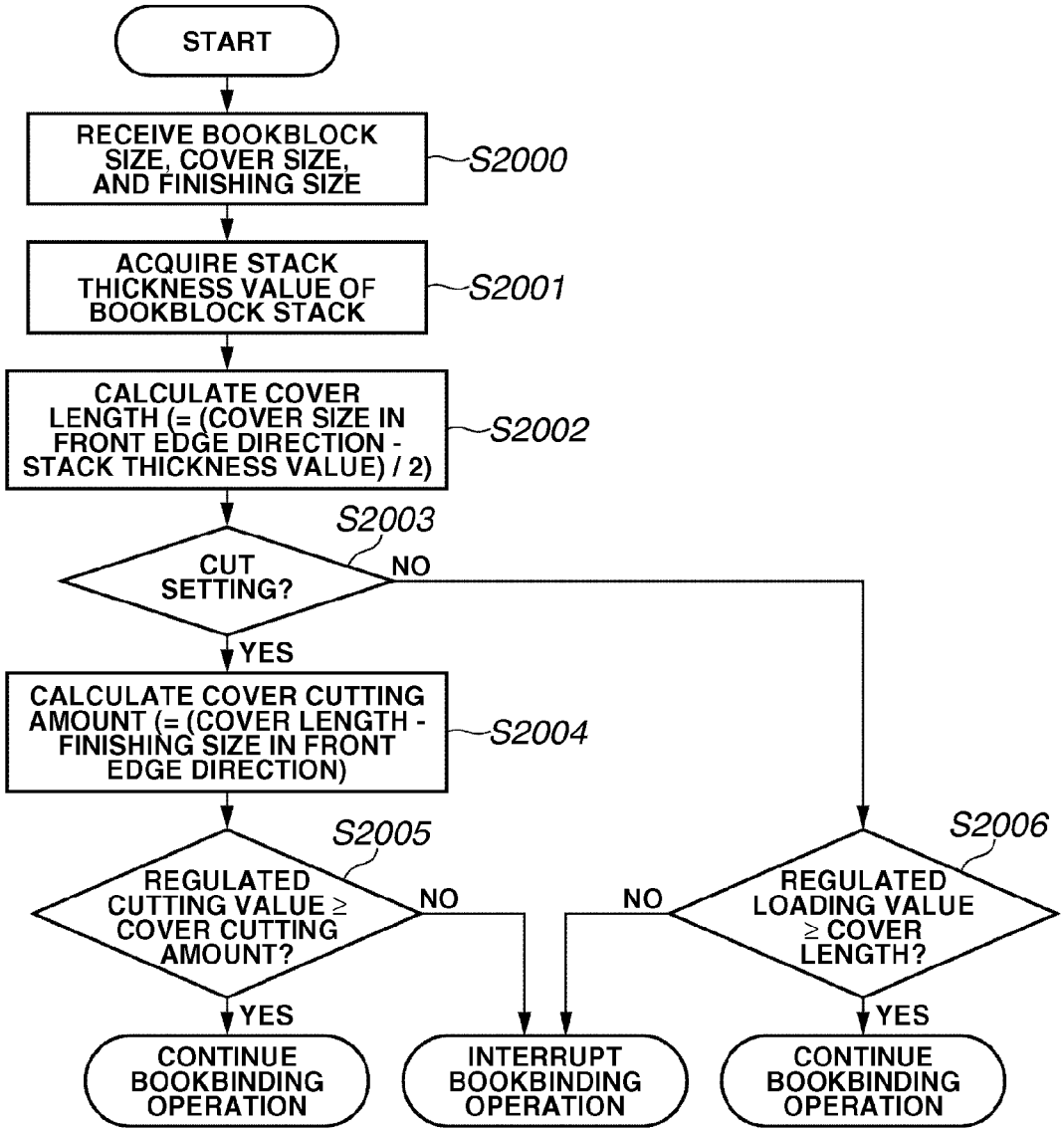
FIG. 43 is a flowchart illustrating example processing that a bookbinding permission/inhibition determination unit can perform according to a first exemplary embodiment.

FIG. 43 is a flowchart illustrating example processing performed by the bookbinding permission/inhibition determination unit 915 of the case bookbinding apparatus 500.

At step S2000, the bookbinding permission/inhibition determination unit 915 receives various setting values (e.g., bookblock size, cover size, and finishing size) in the bookbinding mode from the image forming apparatus 10 via the communication IF 907.

At step S2001, the bookbinding permission/inhibition determination unit 915 acquires a stack thickness value of a bookblock stack from the stack thickness detection unit 912. In this example, various setting values are as follows.

bookblock size A4 (210 mm×297 mm)
cover size user-defined size (297 mm×430 mm)
finishing size 171 mm×250 mm
stack thickness value obtained by stack thickness calculating unit 10 mm At step S2002, the bookbinding permission/inhibition determination unit 915 causes the cover length calculation unit 913 to calculate a length of the cover based on the setting values received from the image forming apparatus 10. More specifically, the cover length calculation unit 913 calculates a cover length of a bookbinding product according to the above-described formula 1 as follows.

$$\text{Cover length}=(430\ \text{mm}-10\ \text{mm})/2=210\ \text{mm}$$

After the cover length calculation unit 913 completes calculation of the cover length in the front edge direction, the processing flow proceeds to step S2003. At step S2003, the bookbinding permission/inhibition determination unit 915 determines whether the bookbinding setting includes cut setting. If the bookbinding permission/inhibition determination unit 915 determines that the bookbinding setting includes cut setting (YES in step S2003), the processing flow proceeds to step S2004. At step S2004, the bookbinding permission/inhibition determination unit 915 causes the cover cutting amount calculation unit 914 to calculate a cover cutting amount according to the above-described formula (2).

$$\text{Cover cutting amount}=210\ \text{mm}-171\ \text{mm}=39\ \text{mm}$$

Figure 49:
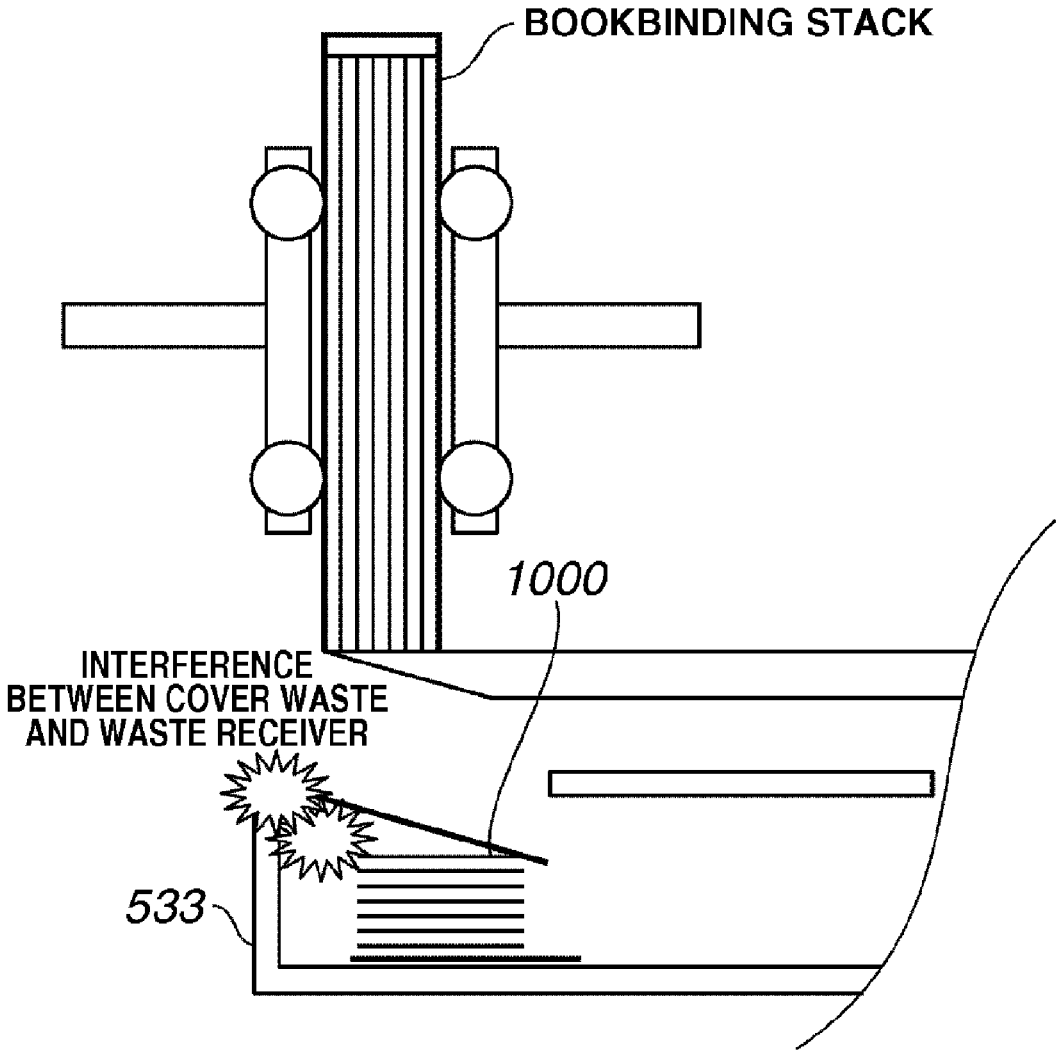
FIG. 49 illustrates an example state where a cut waste interferes with a receiver (exceeds a regulated cutting value).

Then, at step S2005, the bookbinding permission/inhibition determination unit 915 compares the cover cutting amount (39 mm in this embodiment) calculated by the cover cutting amount calculation unit 914 with a regulated cutting value of the case bookbinding apparatus 500 and determines permission/inhibition of a bookbinding operation. If the cover cutting amount is greater than the regulated cutting value (NO in step S2005), i.e., if a cut waste of the cover is excessively large, the cover waste 1000 may interfere with the waste receiver 533 as illustrated in FIG. 49.

Accordingly, if the cover cutting amount is not within a regulated range, i.e., if the cover cutting amount is greater than the regulated cutting value, the bookbinding permission/inhibition determination unit 915 instructs the bookbinding operation interrupting unit 811 to interrupt the bookbinding operation. On the other hand, if the cover cutting amount is equal to or less than the regulated cutting value (YES in step S2005), the cover waste 1000 does not interfere with the waste receiver 533. Therefore, the bookbinding permission/inhibition determination unit 915 determines to continue the bookbinding operation.

If the bookbinding permission/inhibition determination unit 915 determines that the bookbinding setting does not include any cut setting (NO in step S2003), the processing flow proceeds to step S2006. At step S2006, the bookbinding permission/inhibition determination unit 915 compares the cover length (210 mm in this embodiment) with a regulated loading value of the case bookbinding apparatus 500 and determines permission/inhibition of the bookbinding operation.

Figure 50:
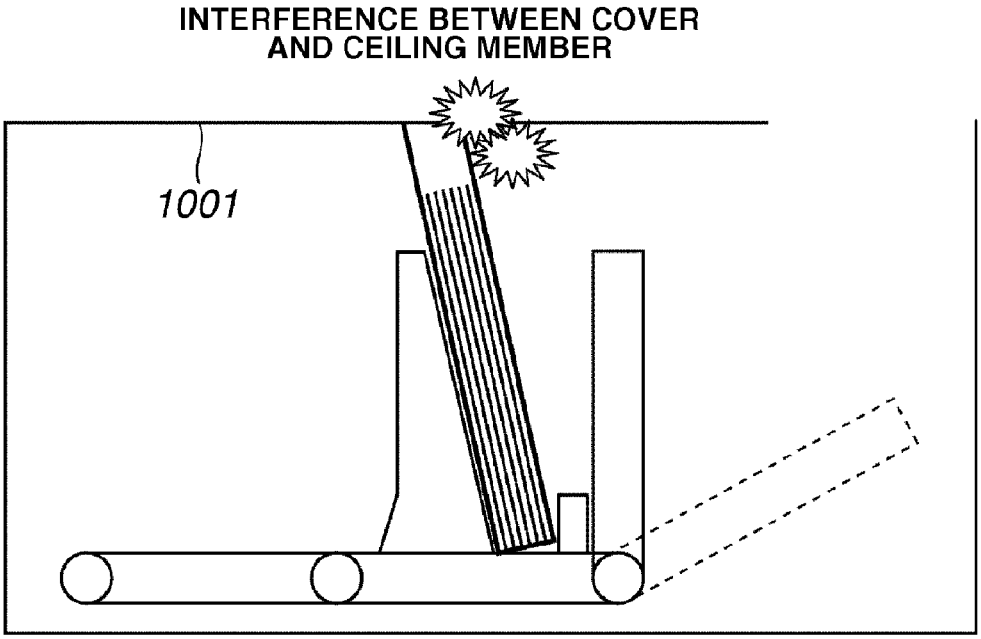
FIG. 50 illustrates an example state where a cover interferes with a ceiling member (exceeds a regulated loading value).

If the cover length is greater than the regulated loading value (NO in step S2006), i.e., if the bookbinding length in a front edge direction is excessively long, a bookbinding product may interfere with the ceiling member 1001 of the finished book discharge unit E as illustrated in FIG. 50. If the cover length is greater than the regulated loading value, the bookbinding permission/inhibition determination unit 915 causes the bookbinding operation interrupting unit 811 to interrupt the bookbinding operation. If the cover length is equal to or less than the regulated loading value (YES in step S2006), the bookbinding product does not interfere with the ceiling member 1001 of the finished book discharge unit E. Therefore, the bookbinding permission/inhibition determination unit 915 permits continuation of the bookbinding operation.

The bookbinding operation interrupting unit 811 receives an interrupt instruction of the bookbinding operation transmitted from the bookbinding permission/inhibition determination unit 915 via the communication IF 807, the CPU 801, and the bookbinding control unit 810. The bookbinding operation interrupting unit 811 temporarily interrupts the bookbinding operation if the bookbinding permission/inhibition determination unit 915 determines that the bookbinding operation is infeasible. As an example interrupting method, the bookbinding operation interrupting unit 811 can forcibly generate a jam in the case bookbinding apparatus 500 to stop the system.

Figure 44A:
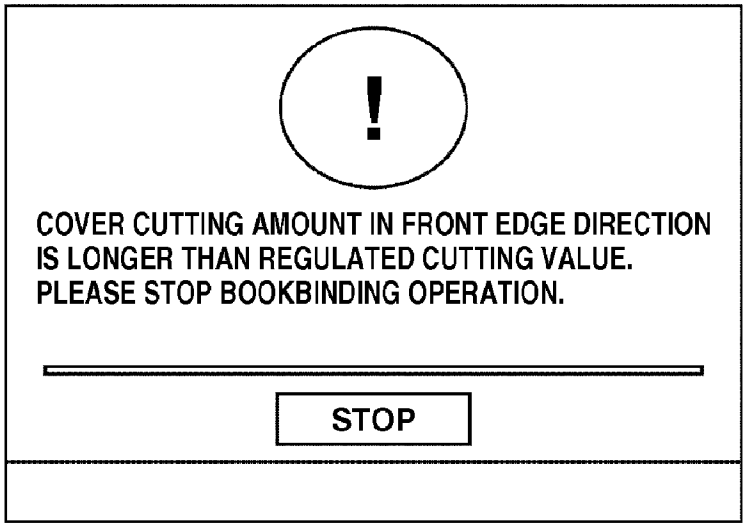
FIGS. 44A and 44B illustrate warning screens that a display unit can display according to the first exemplary embodiment.
Figure 44B:
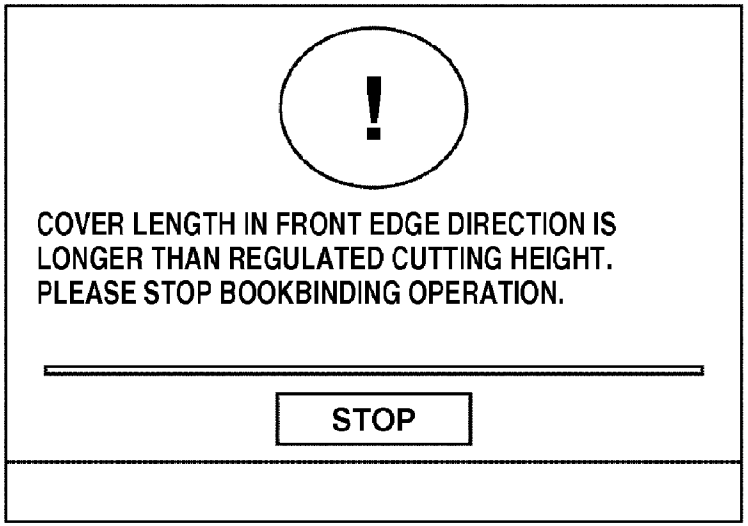

If the bookbinding permission/inhibition determination unit 915 determines that the bookbinding operation is infeasible, the job cancel control unit 813 causes the display unit 620 of the operation display unit 600 to open a warning screen illustrated in FIG. 44A or 44B. The warning screen notifies a user about infeasibility of the bookbinding operation. Then, if a user presses a stop key to cancel a bookbinding job, the job cancel control unit 813 cancels the bookbinding job.

FIG. 44A illustrates an example bookbinding interrupt display screen displayed when the cover cutting amount exceeds the regulated cutting value of the case bookbinding apparatus 500. FIG. 44B illustrates an example bookbinding interrupt display screen displayed when the cover length exceeds the regulated loading value of the case bookbinding apparatus 500.

As described above, the first exemplary embodiment provides a bookbinding system and a bookbinding apparatus that can prevent a bookbinding apparatus from malfunctioning and can secure a satisfactory quality level of a bookbinding product, thereby improving the usability of the system.

Second Exemplary Embodiment

Next, a second exemplary embodiment of the present invention is described. In the second exemplary embodiment, the bookbinding operation interrupting unit 811 does not forcibly generate a jam in the case bookbinding apparatus 500, but postpones the feeding of a cover until the bookbinding permission/inhibition determination unit 915 completes determination with respect to permission/inhibition of a bookbinding operation.

Figure 45:
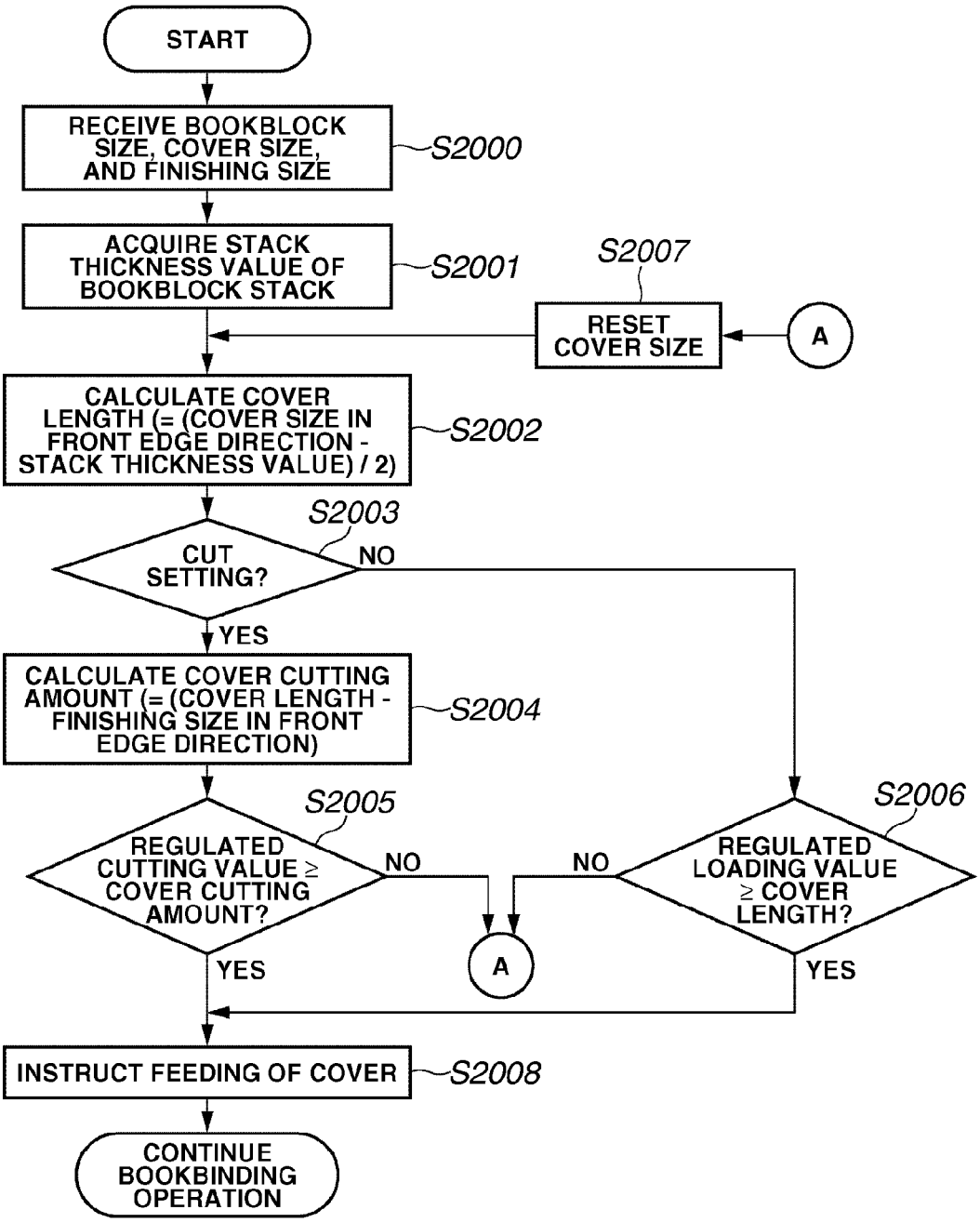
FIG. 45 is a flowchart illustrating example processing that a bookbinding permission/inhibition determination unit can perform according to a second exemplary embodiment.

FIG. 45 is a flowchart illustrating example processing according to the second exemplary embodiment. The bookbinding permission/inhibition determination unit 915 of the case bookbinding apparatus 500 executes the processing illustrated in FIG. 45. Steps S2000 through S2006 illustrated in FIG. 45 are already described in FIG. 43. Therefore, descriptions of steps S2000 through S2006 are omitted.

If in step S2005 the cover cutting amount is greater than the regulated cutting value, i.e., if a cut waste of the cover is excessively large, the cover waste 1000 may interfere with the waste receiver 533 as illustrated in FIG. 49. Therefore, if the cover cutting amount is greater than the regulated cutting value (NO in step S2005), the processing flow proceeds to step S2007. At step S2007, the bookbinding permission/inhibition determination unit 915 instructs the cover size resetting unit 812 to reset the cover size.

If in step S2006 the cover length is longer than the regulated loading value, i.e., if the bookbinding length in the front edge direction is excessively long, a bookbinding product may interfere with the ceiling member 1001 of the finished book discharge unit E as illustrated in FIG. 50. Therefore, if the cover length is longer than the regulated loading value (NO in step S2006), the processing flow proceeds to step S2007. At step S2007, the bookbinding permission/inhibition determination unit 915 instructs the cover size resetting unit 812 to reset the cover size.

If in step S2007 the bookbinding permission/inhibition determination unit 915 receives a reset cover size from the cover size resetting unit 812, the processing flow proceeds to step S2002. At step S2002, the bookbinding permission/inhibition determination unit 915 causes the cover length calculation unit 913 to calculate a length of the cover again.

Then, at step S2003, the bookbinding permission/inhibition determination unit 915 determines whether the bookbinding setting includes cut setting. If the bookbinding setting includes cut setting, the processing flow proceeds to step S2004. At step S2004, the bookbinding permission/inhibition determination unit 915 causes the cover cutting amount calculation unit 914 to calculate a cover cutting amount.

If the cover cutting amount is equal to or less than the regulated cutting value (YES in step S2005), the cover waste 1000 does not interfere with the waste receiver 533. Therefore, in step S2008, the bookbinding permission/inhibition determination unit 915 instructs the image forming apparatus 10 to perform a cover feeding operation. Furthermore, if the cover length is equal to or less than the regulated loading value (YES in step S2006), the bookbinding product does not interfere with the ceiling member 1001 of the finished book discharge unit E. Therefore, in step S2008, the bookbinding permission/inhibition determination unit 915 instructs the image forming apparatus 10 to perform a cover feeding operation.

Figure 46A:
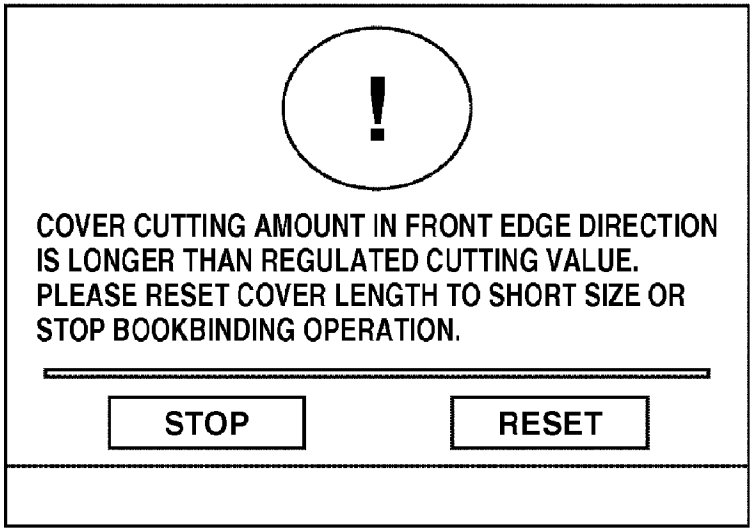
FIGS. 46A and 46B illustrate warning screens that a display unit can display according to the second exemplary embodiment.
Figure 46B:
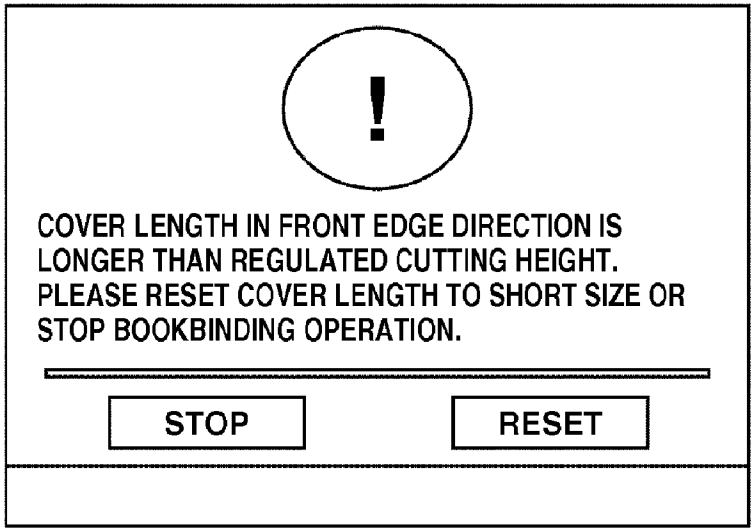

The cover size resetting unit 812 is described below. The cover size resetting unit 812 instructs the operation display unit 600 to display a warning screen illustrated in FIG. 46A or 46B on the display unit 620. The warning screen instructs a user to reset a cover size. According to the first exemplary embodiment, the warning screen illustrated in FIG. 44A or 44B includes only a "stop" key to stop the job. In the second exemplary embodiment, the warning screen illustrated in FIG. 46A or 46B includes a "reset" key to reset the cover size, in addition to the "stop" key.

If a user resets the cover, the cover size resetting unit 812 transmits a newly set cover size to the bookbinding permission/inhibition determination unit 915. The bookbinding permission/inhibition determination unit 915 performs a bookbinding permission/inhibition determination based on the received cover size (i.e., reset value).

As described above, the bookbinding permission/inhibition determination unit 915 does not permit the cover feeding operation before completing setting of an appropriate cover size. The cover feeding operation is postponed because if the cover is fed before the bookbinding permission/inhibition determination unit 915 completes the bookbinding permission/inhibition determination, the fed cover may become unnecessary depending on the determination result. In this case, a user needs to remove the unnecessary cover from the case bookbinding apparatus 500 and the removal work can be troublesome.

The second exemplary embodiment postpones the cover feeding operation until an appropriate cover size is set. Thus, the cover is not fed if an inappropriate cover size is set. Therefore, a user does not need to remove a cover unnecessarily fed into the case bookbinding apparatus 500. Namely, the second exemplary embodiment can provide a bookbinding apparatus and a bookbinding system which can be easily operated by a user.

Third Exemplary Embodiment

A third exemplary embodiment of the present invention is described below. The above-described second exemplary embodiment postpones the cover feeding operation and therefore may deteriorate the productivity. The third exemplary embodiment includes processing for determining whether to postpone the above-described cover feeding operation. Thus, the third exemplary embodiment can reduce the number of cover feeding postponing operations and avoid deterioration of the productivity.

Figure 47:
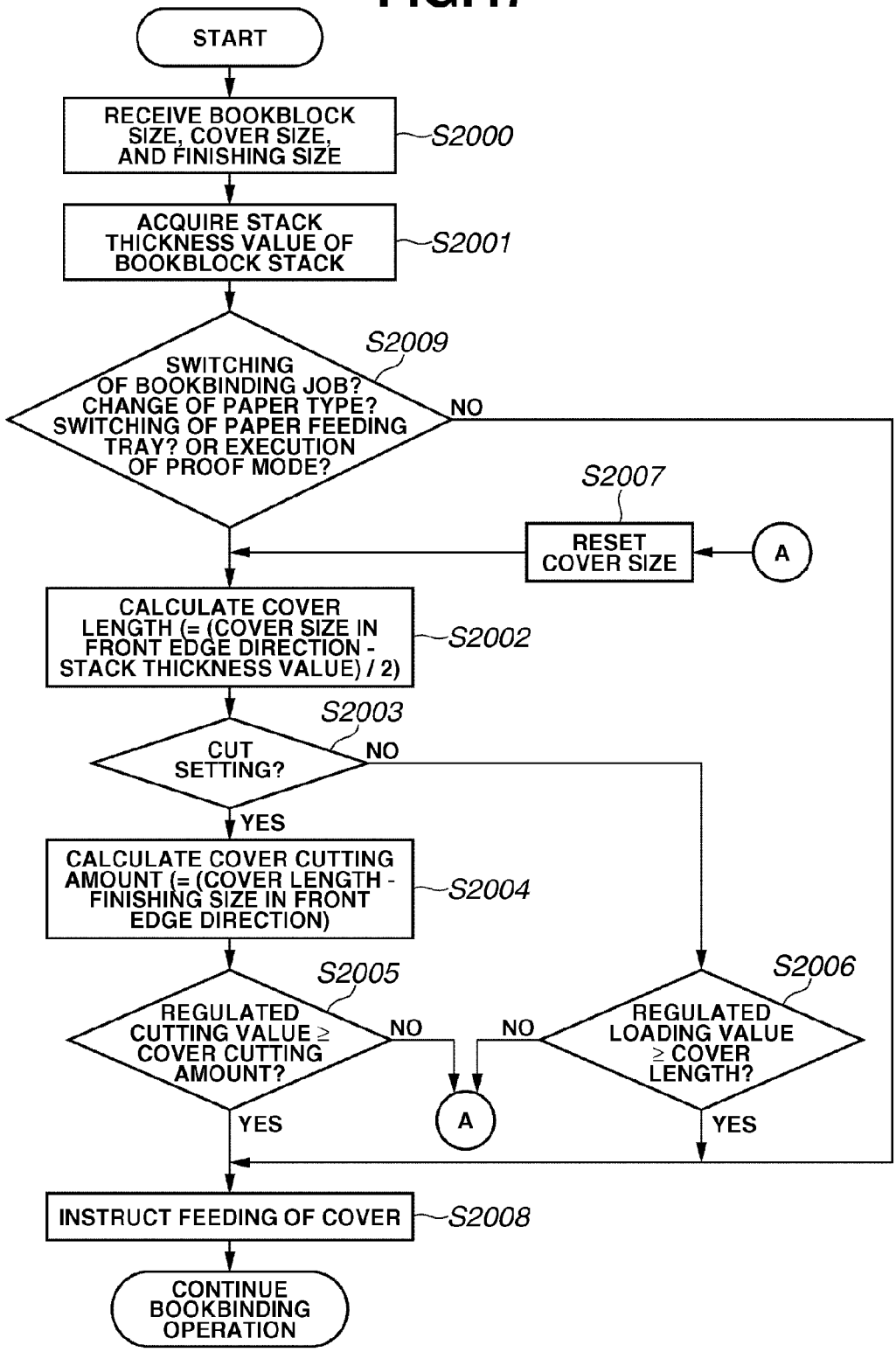
FIG. 47 is a flowchart illustrating example processing that a bookbinding permission/inhibition determination unit can perform according to a third exemplary embodiment.
Figure 48:
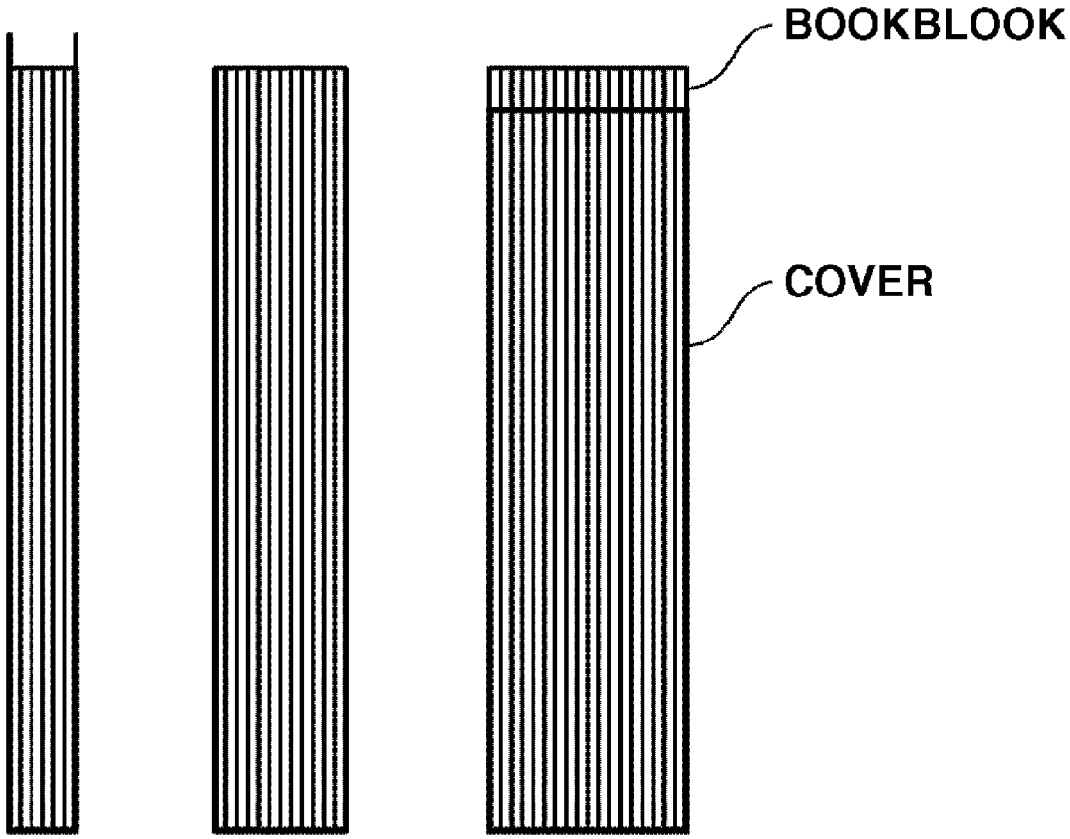
FIG. 48 illustrates variation of a cover length in a front edge direction according to a stack thickness of a bookblock stack.

FIG. 47 is a flowchart illustrating example processing according to the third exemplary embodiment. The bookbinding permission/inhibition determination unit 915 of the case bookbinding apparatus 500 executes the processing illustrated in FIG. 47. Steps S2000 through S2008 illustrated in FIG. 47 are already described in FIG. 45. Therefore, descriptions of steps S2000 through S2008 are omitted.

In general, it is presumed that bookbinding setting, a paper type, and stack thickness conditions do not change during execution of a bookbinding job. Hence, at step S2009, the bookbinding permission/inhibition determination unit 915 determines whether there is any switching of the bookbinding job. If there is not any switching of the bookbinding job (NO in step S2009), the bookbinding permission/inhibition determination unit 915 skips the processing to be performed in steps S2002 through S2006. Then, at step S2008, the bookbinding permission/inhibition determination unit 915 instructs the image forming apparatus 10 to feed a cover. In this case, the cover feeding operation is not postponed and therefore the productivity can be maintained at an appropriate level.

If the bookbinding job is switched due to a change in the bookbinding setting, a paper type, or stack thickness conditions (YES in step S2009), the bookbinding permission/inhibition determination unit 915 performs the bookbinding permission/inhibition processing (steps S2002 through S2006). In this case, similar to the second exemplary embodiment, the cover feeding operation is postponed.

In the foregoing description, the bookbinding permission/inhibition determination unit 915 does not postpone the cover feeding operation during execution of a bookbinding job. However, the bookbinding permission/inhibition determination unit 915 can postpone the cover feeding operation in the following situations regardless of execution of a bookbinding job.

(1) Change of Paper Type

The stack thickness of a bookbinding product is variable if the paper type is changed. Accordingly, at step S2009, the bookbinding permission/inhibition determination unit 915 determines whether the paper type has changed. Then, if it is determined that the paper type has changed (YES in step S2009), the bookbinding permission/inhibition determination unit 915 performs the bookbinding permission/inhibition processing (steps S2002 through S2006). The cover feeding operation is postponed.

(2) Switching of Paper Feeding Tray

It cannot be assured that a paper type and thickness conditions are same before and after a paper feeding tray is switched. Therefore, the bookbinding permission/inhibition determination unit 915 performs the bookbinding permission/inhibition processing (steps S2002 through S2006). The cover feeding operation is postponed.

(3) Execution of Proof Mode

In a "proof mode", the system executes an interrupt job that enables a user to confirm an image forming state during execution of a print job. At step S2009, the bookbinding permission/inhibition determination unit 915 determines whether the proof mode has been executed. If it is determined that the proof mode has been executed (YES in step S2009), the bookbinding permission/inhibition determination unit 915 performs the bookbinding permission/inhibition processing (steps S2002 through S2006). The cover feeding operation is postponed.

As described above, the third exemplary embodiment includes the processing for determining whether to postpone the cover feeding operation in consideration of deterioration of the productivity caused by postponing the cover feeding operation. Thus, the third exemplary embodiment can reduce the number of cover feeding postponing operations and improve the productivity.

As described above, the case bookbinding apparatus 500 includes the cover length calculation unit 913, the cover cutting amount calculation unit 914, and the bookbinding permission/inhibition determination unit 915. However, the image forming apparatus 10 according to the exemplary embodiments can include the cover length calculation unit 913, the cover cutting amount calculation unit 914, and the bookbinding permission/inhibition determination unit 915.

In the embodiments described above, the stack thickness is measured directly by the stack thickness detection unit 912. However, it is also possible to determine the stack thickness in other ways. For example, it is possible to count the number of sheets to be bound and multiply the sheet thickness by the number of sheets to determine the stack thickness. The sheet thickness may either be known (e.g. set by an operator) or be measured.

While the present invention has been described with reference to the exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A bookbinding system including an image forming apparatus and a bookbinding apparatus connected to the image forming apparatus, the bookbinding system comprising:

an image forming unit configured to form an image on a recording sheet;

a stack unit configured to stack, as a bookblock stack, a plurality of recording sheets on which images are formed by the image forming unit;

a bonding unit configured to form a booklet by bonding a cover sheet with the bookblock stack;

a setting unit configured to set a cover sheet size and a finishing size;

a cutting unit configured to cut the booklet bonded together with the cover sheet by the bonding unit into a booklet having the finishing size set by the setting unit;

a cut waste storing unit configured to store a cut waste of the booklet cut by the cutting unit;

a stack thickness determination unit configured to determine a thickness of the bookblock stack;

a cutting amount determination unit configured to determine a cutting amount of the bookblock stack based on the cover sheet size and the finishing size set by the setting unit and the thickness of the bookblock stack determined by the stack thickness determination unit, the cutting amount corresponding to a size of the cut waste; and a bookbinding permission/inhibition determination unit configured to inhibit a bookbinding operation if the cutting amount determined by the cutting amount determination unit is larger than a predetermined value, and to permit the bookbinding operation if the cutting amount is equal to or smaller than the predetermined value, the predetermined value being a value according to a size of a cut waste receiving portion of the cut waste storing unit.

2. The bookbinding system according to claim 1, wherein the bookbinding permission/inhibition determination unit determines to postpone feeding of a cover sheet if the cutting amount is larger than the predetermined value.

3. The bookbinding system according to claim 2, further comprising a cover size resetting unit configured to instruct a user to reset a cover sheet size by the setting unit, wherein the bookbinding permission/inhibition determination unit determines whether to start feeding of a cover sheet based on a cover sheet size reset by the setting unit.

4. The bookbinding system according to claim 1, further comprising a notification unit configured to notify a user of infeasibility of the bookbinding operation if the bookbinding permission/inhibition determination unit determines that the bookbinding operation is infeasible.

5. A bookbinding system including an image forming apparatus and a bookbinding apparatus connected to the image forming apparatus, the bookbinding system comprising:

an image forming unit configured to form an image on a recording sheet;

a stack unit configured to stack, as a bookblock stack, a plurality of recording sheets on which images are formed by the image forming unit;

a bonding unit configured to form a booklet by bonding a cover sheet with the bookblock stack;

a discharge unit to which the booklet formed by the bonding unit is discharged;

a setting unit configured to set a cover sheet size and a finishing size;

a stack thickness detection unit configured to detect a thickness of the bookblock stack;

a length determination unit configured to determine a length of the booklet in a direction from a back to a fore edge based on the cover sheet size and the finishing size set by the setting unit and the thickness of the bookblock stack determined by the stack thickness determination unit; and a bookbinding permission/inhibition determination unit configured to inhibit a bookbinding operation if the length determined by the length determination unit is longer than a predetermined value, and to permit the bookbinding operation if the length is equal to or shorter than the predetermined value, the predetermined value being a value according to a size of a receiving portion of the discharge unit to receive the booklet.

6. The bookbinding system according to claim 5, wherein the bookbinding permission/inhibition determination unit determines to postpone feeding of a cover sheet if the length is longer than the predetermined value.

7. The bookbinding system according to claim 1, further comprising a cover size resetting unit configured to instruct a user to reset thea cover sheet size by the setting unit, wherein the bookbinding permission/inhibition determination unit determines whether to start feeding of a cover sheet based on a cover sheet size reset by the setting unit.

8. The bookbinding system according to claim 5, further comprising a notification unit configured to notify a user of infeasibility of the bookbinding operation if the bookbinding permission/inhibition determination unit determines that the bookbinding operation is infeasible.

9. A bookbinding apparatus connectable to an image forming apparatus, the bookbinding apparatus comprising:

a stack unit configured to stack, as a bookblock stack, a plurality of recording sheets discharged from the image forming apparatus;

a bonding unit configured to form a booklet by bonding a cover sheet with the bookblock stack;

a reception unit configured to receive a cover sheet size, and a finishing size from the image forming apparatus;

a cutting unit configured to cut the booklet bonded together with the cover sheet by the bonding unit into a booklet having the finishing size received by the reception unit;

a cut waste storing unit configured to store a cut waste of the booklet cut by the cutting unit;

a stack thickness determination unit configured to determine a thickness of the bookblock stack;

a cutting amount determination unit configured to determine a cutting amount of the bookblock stack based on the cover sheet size and the finishing size received by the reception unit and the thickness of the bookblock stack determined by the stack thickness determination unit, the cutting amount corresponding to a size of the cut waste; and a bookbinding permission/inhibition determination unit configured to inhibit a bookbinding operation if the cutting amount determined by the cutting amount determination unit is larger than a predetermined value, and to permit the bookbinding operation if the cutting amount is equal to or smaller than the predetermined value, the predetermined value being a value according to a size of a cut waste receiving portion of the cut waste storing unit.

10. A bookbinding apparatus connectable to an image forming apparatus, the bookbinding apparatus comprising:

a stack unit configured to stack, as a bookblock stack, recording sheets discharged from the image forming apparatus;

a bonding unit configured to form a booklet by bonding a cover sheet with the bookblock stack;

a discharge unit to which the booklet formed by the bonding unit is discharged;

a reception unit configured to receive a cover sheet size from the image forming apparatus;

a stack thickness determination unit configured to determine a thickness of the bookblock stack;

a length determination unit configured to determine a length of the booklet in a direction from a back to a fore edge based on the cover sheet size received by the reception unit and the thickness of the bookblock stack determined by the stack thickness determination unit; and a bookbinding permission/inhibition determination unit configured to inhibit a bookbinding operation if the length determined by the length determination unit is longer than a predetermined value, and to permit the bookbinding operation if the length is equal to or smaller than the predetermined value, the predetermined value being a value according to a size of a receiving portion of the discharge unit to receive the booklet.

* * * * *